US012123614B2

(12) United States Patent
Zhang et al.

(10) Patent No.: US 12,123,614 B2
(45) Date of Patent: Oct. 22, 2024

(54) DUCTED AIR CONDITIONER AND ASSEMBLING METHOD THEREOF

(71) Applicant: Qingdao Hisense Hitachi Air-Conditioning Systems Co., Ltd., Shandong (CN)

(72) Inventors: Wenqiang Zhang, Shandong (CN); Ronghai Zhang, Shandong (CN); Detong Yu, Shandong (CN); Biao Zhang, Shandong (CN)

(73) Assignee: QINGDAO HISENSE HITACHI AIR-CONDITIONING SYSTEMS CO., LTD., Shandong (CN)

( * ) Notice: Subject to any disclaimer, the term of this patent is extended or adjusted under 35 U.S.C. 154(b) by 259 days.

(21) Appl. No.: 17/731,870

(22) Filed: Apr. 28, 2022

(65) Prior Publication Data

US 2022/0252300 A1 Aug. 11, 2022

Related U.S. Application Data

(63) Continuation-in-part of application No. PCT/CN2020/079500, filed on Mar. 16, 2020, and a (Continued)

(30) Foreign Application Priority Data

Oct. 31, 2019 (CN) ..... 201911053161.6
Oct. 31, 2019 (CN) ..... 201911053175.8

(Continued)

(51) Int. Cl.
*F24F 13/20* (2006.01)
*F24F 1/0063* (2019.01)

(Continued)

(52) U.S. Cl.
CPC ..... *F24F 13/20* (2013.01); *F24F 1/0063* (2019.02); *F24F 13/02* (2013.01); *F24F 13/222* (2013.01); *F24F 13/30* (2013.01)

(58) Field of Classification Search
CPC ..... F24F 13/222; F24F 1/0063; F24F 13/20; F24F 13/30
See application file for complete search history.

(56) References Cited

U.S. PATENT DOCUMENTS 4,240,264 A * 12/1980 Nakada ..... F24F 1/0057 62/262
11,493,230 B2 * 11/2022 Jang ..... F24F 13/06

(Continued)

FOREIGN PATENT DOCUMENTS

CN 203550041 U 4/2014
CN 203797797 U 8/2014

(Continued)

OTHER PUBLICATIONS

International Search Report and Written Opinion issued in corresponding International Application No. PCT/ CN2020/079498 dated Aug. 10, 2020, with English translation.

(Continued)

*Primary Examiner* — Nelson J Nieves
(74) *Attorney, Agent, or Firm* — Morgan, Lewis & Bockius LLP

(57) ABSTRACT

A ducted air conditioner includes a housing, a heat-retaining and drainage assembly, a fan assembly and an air conditioning device. The heat-retaining and drainage assembly is disposed in the housing, and includes a first heat-retaining member and a second heat-retaining member. The first heat-retaining member includes a first dividing plate. The second heat-retaining member is stacked with the first heat-retaining member, the second heat-retaining member includes a second dividing plate connected to the first (Continued)

heat-retaining member. An inner space of the housing is divided to a first cavity and a second cavity, an arrangement direction of the first cavity and the second cavity is perpendicular to a stacking direction of the first heat-retaining member and the second heat-retaining member. The fan assembly is disposed in the first cavity. The air conditioning device is disposed in the second cavity, and located between the first heat-retaining member and the second heat-retaining member.

20 Claims, 10 Drawing Sheets

Related U.S. Application Data continuation-in-part of application No. PCT/CN2020/079507, filed on Mar. 16, 2020, and a continuation-in-part of application No. PCT/CN2020/079498, filed on Mar. 16, 2020, and a continuation-in-part of application No. PCT/CN2020/079501, filed on Mar. 16, 2020.

(30) Foreign Application Priority Data

| | | |
|---|---|---|
| Oct. 31, 2019 | (CN) | 201911053185.1 |
| Oct. 31, 2019 | (CN) | 201911054429.8 |
| Oct. 31, 2019 | (CN) | 201921857719.1 |
| Oct. 31, 2019 | (CN) | 201921857720.4 |
| Oct. 31, 2019 | (CN) | 201921858792.0 |
| Oct. 31, 2019 | (CN) | 201921858814.3 |

(51) Int. Cl.

| | |
|---|---|
| ***F24F 13/02*** | (2006.01) |
| ***F24F 13/22*** | (2006.01) |
| ***F24F 13/30*** | (2006.01) |

(56) References Cited

U.S. PATENT DOCUMENTS

| | | | | |
|---|---|---|---|---|
| 2016/0131368 | A1 | 5/2016 | Tomoigawa | |
| 2018/0180318 | A1 | 6/2018 | Shiomi | |
| 2018/0195790 | A1* | 7/2018 | Fushimi | F24F 1/0007 |
| 2020/0309405 | A1* | 10/2020 | Jang | F24F 13/081 |
| 2020/0318887 | A1* | 10/2020 | Tsutsumi | F24F 11/88 |
| 2021/0293443 | A1* | 9/2021 | Inagaki | F24F 13/22 |
| 2022/0252299 | A1* | 8/2022 | Ishigami | F24F 13/20 |

FOREIGN PATENT DOCUMENTS

| | | | |
|---|---|---|---|
| CN | 203835802 | U | 9/2014 |
| CN | 203837235 | U | 9/2014 |
| CN | 204555054 | U | 8/2015 |
| CN | 204648454 | U | 9/2015 |
| CN | 105258216 | A | 1/2016 |
| CN | 205048550 | U | 2/2016 |
| CN | 106765637 | A | 5/2017 |
| CN | 206269322 | U | 6/2017 |
| CN | 107192020 | A | 9/2017 |
| CN | 107796105 | A | 3/2018 |
| CN | 107850331 | A | 3/2018 |
| CN | 207335115 | U | 5/2018 |
| CN | 207702696 | U | 8/2018 |
| CN | 108489156 | A | 9/2018 |
| CN | 207907441 | U | 9/2018 |
| CN | 108844205 | A | 11/2018 |
| CN | 109282359 | A | 1/2019 |
| CN | 209068728 | U | 7/2019 |
| CN | 210980109 | U | 7/2020 |
| EP | 3 081 867 | A1 | 10/2016 |
| JP | H03-213918 | A | 9/1991 |
| JP | 2006-097937 | A | 4/2006 |
| JP | 2017-048966 | A | 3/2017 |
| JP | 2019-052793 | A | 4/2019 |
| KR | 10-2018-0111270 | A | 10/2018 |
| WO | 2015-025342 | A1 | 8/2013 |

OTHER PUBLICATIONS

International Search Report and Written Opinion issued in corresponding International Application No. PCT/ CN2020/079500 dated Jul. 29, 2020, with English translation.

International Search Report and Written Opinion issued in corresponding International Application No. PCT/ CN2020/079501 dated Jul. 29, 2020, with English translation.

International Search Report and Written Opinion issued in corresponding International Application No. PCT/ CN2020/079507 dated Jul. 24, 2020, with English translation.

Office Action issued on Aug. 2, 2024 in Chinese Patent Application No. 201911053161.6 with English tranlsation.

* cited by examiner

DUCTED AIR CONDITIONER AND ASSEMBLING METHOD THEREOF

CROSS-REFERENCE TO RELATED APPLICATIONS

This application is a continuation-in-part application of International Patent Application No. PCT/CN2020/079501, filed on Mar. 16, 2020, which claims priorities to Chinese Patent Application No. 201911053161.6, filed on Oct. 31, 2019, and Chinese Patent Application No. 201921857719.1, filed on Oct. 31, 2019; this application is a continuation-in-part application of International Patent Application No. PCT/CN2020/079498, filed on Mar. 16, 2020, which claims priorities to Chinese Patent Application No. 201911053175.8, filed on Oct. 31, 2019, and Chinese Patent Application No. 201921858814.3, filed on Oct. 31, 2019; this application is a continuation-in-part application of International Patent Application No. PCT/CN2020/079507, filed on Mar. 16, 2020, which claims priorities to Chinese Patent Application No. 201911053185.1, filed on Oct. 31, 2019, and Chinese Patent Application No. 201921858792.0, filed on Oct. 31, 2019, and this application is a continuation-in-part application of International Patent Application No. PCT/CN2020/079500, filed on Mar. 16, 2020, which claims priorities to Chinese Patent Application No. 201911054429.8, filed on Oct. 31, 2019, and Chinese Patent Application No. 201921857720.4, filed on Oct. 31, 2019. The entire contents of the foregoing applications are incorporated herein by reference in their entireties.

TECHNICAL FIELD

The present disclosure relates to the field of air conditioning technologies, and in particular, to a ducted air conditioner and an assembling method thereof.

BACKGROUND

The ducted air conditioner is an indoor unit of a ducted air conditioning system, which transmits cold or warm air into the indoors through air ducts. Since the ducted air conditioner may be installed in a hidden way, it has less effects on the aesthetically pleasing of the indoor and is convenient to maintain, so it is widely used.

SUMMARY

In an aspect, a ducted air conditioner is provided. The ducted air conditioner includes a housing, a heat-retaining and drainage assembly, a fan assembly and an air conditioning device. The heat-retaining and drainage assembly is disposed in the housing, and includes a first heat-retaining member and a second heat-retaining member. The first heat-retaining member includes a first dividing plate. The second heat-retaining member is stacked with the first heat-retaining member, the second heat-retaining member includes a second dividing plate connected to the first dividing plate. An inner space of the housing is divided to a first cavity and a second cavity, an arrangement direction of the first cavity and the second cavity is perpendicular to a stacking direction of the first heat-retaining member and the second heat-retaining member. The fan assembly is disposed in the first cavity. The air conditioning device is disposed in the second cavity, and is located between the first heat-retaining member and the second heat-retaining member.

In another aspect, an assembling method of a ducted air conditioner is provided. The ducted air conditioner includes a housing, an electrical control box, a heat-retaining and drainage assembly, an air conditioning device and a fan assembly. The housing includes a box body and a cover plate. The box body has an opening. The cover plate is configured to close the opening. The heat-retaining and drainage assembly includes a first heat-retaining member and a second heat-retaining member. The first heat-retaining member includes a first dividing plate. The second heat-retaining member is stacked with the first heat-retaining member, the second heat-retaining member includes a second dividing plate connected to the first dividing plate. An inner space of the housing is divided to a first cavity and a second cavity, an arrangement direction of the first cavity and the second cavity is perpendicular to a stacking direction of the first heat-retaining member and the second heat-retaining member. The method includes: mounting the box body; mounting the electrical control box, and clamping the electrical control box with the box body, so that the electrical control box is located at an end of the first cavity along a length direction of the first cavity; installing the first heat-retaining member in the box body, so that the first heat-retaining member is located between the electrical control box and a third side plate of the box body; installing and fixing the air conditioning device in the box body, so that the air conditioning device is located at a side of the first heat-retaining member proximate to the cover plate; abutting and connecting the second heat-retaining member with the first heat-retaining member, so that the air conditioning device is located in the second cavity; installing the fan assembly in the first cavity; and clamping the cover plate and the box body.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings in the following description may be regarded as schematic diagrams, and are not limitations on actual size of products, actual processes of methods and actual timings of signals to which the embodiments of the present disclosure relate.

DETAILED DESCRIPTION

Figure 1:
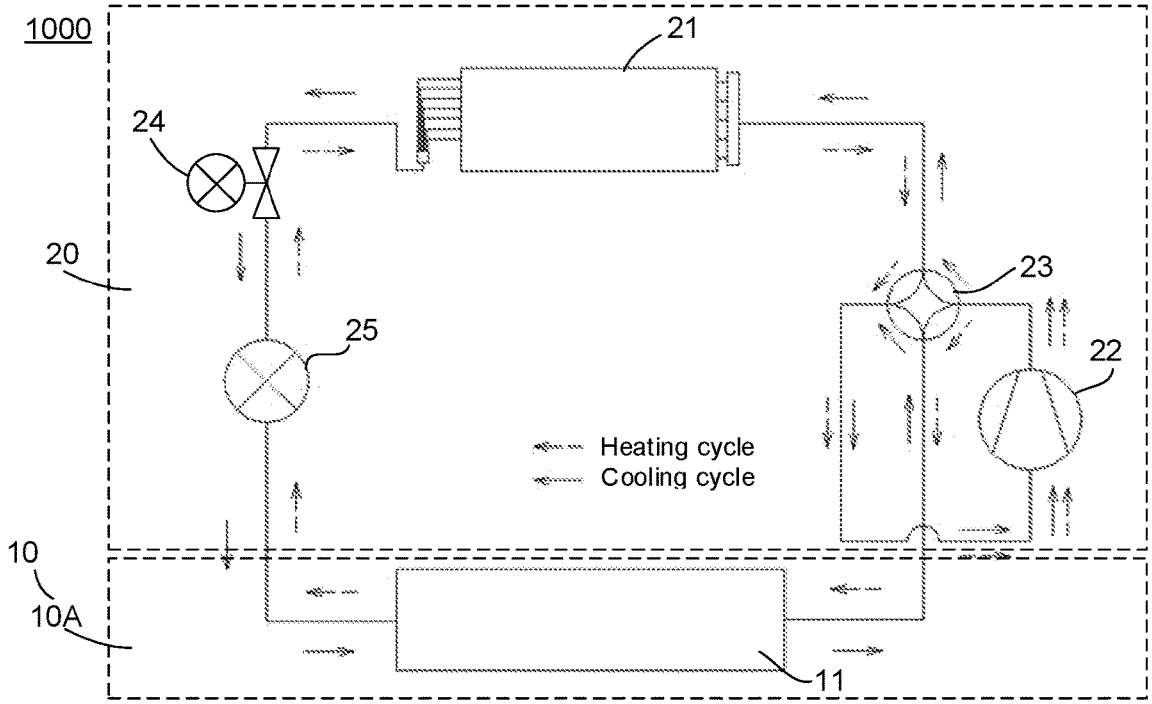
FIG. 1 is a schematic diagram of a ducted air conditioner, in accordance with some embodiments.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as being open and inclusive, meaning "including, but not limited to". In the description, the terms such as "one embodiment", "some embodiments", "exemplary embodiments", "example", "specific example" or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined as "first" and "second" may explicitly or implicitly include one or more of the features. In the description of the embodiments of the present disclosure, the term "a/the plurality of" means two or more unless otherwise specified.

In the description of some embodiments, the term "coupled" and "connected" and their derivatives may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has a same meaning as the phrase "at least one of A, B or C", and they both include the following combinations of A, B and C: only A, only B, only C, a combination of A and B, a combination of A and C, a combination of B and C, and a combination of A, B and C.

The phrase "A and/or B" includes the following three combinations: only A, only B, and a combination of A and B.

The use of the phrase "applicable to" or "configured to" herein means an open and inclusive language, which does not exclude devices that are applicable to or configured to perform additional tasks or steps.

In addition, the use of the phrase "based on" is meant to be open and inclusive, since a process, step, calculation or other action that is "based on" one or more of the stated conditions or values may, in practice, be based on additional conditions or values exceeding those stated.

The term "about", "substantially" or "approximately" as used herein includes a stated value and an average value within an acceptable range of deviation of a particular value. The acceptable range of deviation is determined by a person of ordinary skill in the art, considering measurement in question and errors associated with measurement of a particular quantity (i.e., limitations of a measurement system).

The term such as "parallel", "perpendicular" or "equal" as used herein includes a stated condition and a condition similar to the stated condition. A range of the similar condition is within an acceptable deviation range, and the acceptable deviation range is determined by a person of ordinary skill in the art, considering measurement in question and errors associated with measurement of a particular quantity (i.e., limitations of a measurement system). For example, the term "parallel" includes absolute parallelism and approximate parallelism, and an acceptable deviation range of the approximate parallelism may be, for example, a deviation within 5°. The term "perpendicular" includes absolute perpendicularity and approximate perpendicularity, and an acceptable deviation range of the approximate perpendicularity may also be, for example, a deviation within 5°. The term "equal" includes absolute equality and approximate equality, and an acceptable deviation range of the approximate equality may be that, for example, a difference between the two that are equal is less than or equal to 5% of either of the two.

An air conditioning system 1000 is provided. As shown in FIG. 1, the air conditioning system 1000 includes an indoor unit 10 (including a ducted air conditioner 10A) and an outdoor unit 20. The ducted air conditioner 10A and the outdoor unit 20 are connected by pipes, so as to convey refrigerant.

The ducted air conditioner 10A includes an indoor heat exchanger 11.

The outdoor unit 20 includes an outdoor heat exchanger 21, a compressor 22, a four-way valve 23, an expansion valve 24 and a throttle mechanism 25. In some embodiments, the expansion valve 24 may further be provided in the indoor unit 10. The throttle mechanism 25 may be a throttle valve or a pressure reducer.

The compressor 22, the outdoor heat exchanger 21, the expansion valve 24 and the indoor heat exchanger 11 are connected in sequence to form a refrigerant loop. The refrigerant circulates in the refrigerant loop, and exchanges heat with the air through the outdoor heat exchanger 21 and the indoor heat exchanger 11 respectively, so as to implement cooling or heating of the air conditioning system 1000.

The compressor 22 is configured to compress the refrigerant, so that the refrigerant with low pressure is compressed to be a refrigerant with high pressure.

The outdoor heat exchanger 21 is configured to perform heat-exchange between outdoor air and the refrigerant conveyed in the outdoor heat exchanger 21. For example, the outdoor heat exchanger 21 operates as a condenser in a cooling mode of the air conditioning system 1000, so that the refrigerant compressed by the compressor 22 dissipates heat into the outdoor air through the outdoor heat exchanger 21 and condenses. The outdoor heat exchanger 21 operates as an evaporator in a heating mode of the air conditioning system 1000, so that the decompressed refrigerant absorbs heat in the outdoor air through the outdoor heat exchanger 21 and evaporates.

Generally, the outdoor heat exchanger 21 further includes heat exchange fins, so as to expand a contact area between the outdoor air and the refrigerant conveyed in the outdoor heat exchanger 21, thereby improving heat exchange efficiency between the outdoor air and the refrigerant.

The expansion valve 24 is connected between the outdoor heat exchanger 21 and the indoor heat exchanger 11. A pressure of a refrigerant flowing between the outdoor heat exchanger 21 and the indoor heat exchanger 11 is adjusted by an opening degree of the expansion valve 24, so as to adjust the flow of the refrigerant flowing between the outdoor heat exchanger 21 and the indoor heat exchanger 11. The flow and pressure of the refrigerant flowing between the outdoor heat exchanger 21 and the indoor heat exchanger 11 will affect the heat exchange performance of the outdoor heat exchanger 21 and the indoor heat exchanger 11. The expansion valve 24 may be an electronic valve. The opening degree of the expansion valve 24 is adjustable, so as to control the flow and pressure of the refrigerant flowing through the expansion valve 24.

The four-way valve 23 is connected in the refrigerant loop, and is configured to switch a flow direction of the refrigerant in the refrigerant loop, so as to cause the air conditioning system 1000 to perform the cooling mode or the heating mode.

The throttle mechanism 25 is connected between the expansion valve 24 and the indoor heat exchanger 11. In a case where the air conditioning system 1000 operates in the cooling mode, the throttling mechanism 25 is configured to throttle a supercooled liquid refrigerant flowing out of the outdoor heat exchanger 21 into a gas-liquid two-phase refrigerant with low temperature and low pressure, and the flow direction of the refrigerant is shown by solid arrows in FIG. 1. In a case where the air conditioning system 1000 operates in the heating mode, the throttling mechanism 25 is configured to throttle the supercooled liquid refrigerant flowing out of the indoor heat exchanger 11 into the gas-liquid two-phase refrigerant with low temperature and low pressure, and the flow direction of the refrigerant is shown by dashed arrows in FIG. 1.

The indoor heat exchanger 11 is configured to perform heat-exchange between indoor air and the refrigerant conveyed in the indoor heat exchanger 11. For example, the indoor heat exchanger 11 operates as an evaporator in the cooling mode of the air conditioning system 1000, so that the refrigerant, which has dissipated heat by the outdoor heat exchanger 21, absorbs heat from the indoor air through the indoor heat exchanger 11 and evaporates. The indoor heat exchanger 11 operates as a condenser in the heating mode of the air conditioning system 1000, so that the refrigerant, which has absorbed heat through the outdoor heat exchanger 21, dissipates heat into the indoor air through the indoor heat exchanger 11 and condenses.

Generally, the indoor heat exchanger 11 further includes heat exchange fins, so as to expand a contact area between the indoor air and the refrigerant conveyed in the indoor heat exchanger 11, thereby improving heat exchange efficiency between the indoor air and the refrigerant.

Operation manners of the cooling mode and the heating mode of the air conditioning system 1000 will be described below with reference to FIG. 1.

As shown in FIG. 1, in the case where the air conditioning system 1000 operates in the cooling mode, the refrigerant is compressed by the work of the compressor 22 and becomes a superheated gaseous refrigerant with high temperature and high pressure, and the superheated gaseous refrigerant is discharged into the outdoor heat exchanger 21 for condensation. In the outdoor heat exchanger 21, the superheated gaseous refrigerant is cooled into a supercooled liquid refrigerant, and the supercooled liquid refrigerant flows into the throttling mechanism 25. The throttling mechanism 25 may throttle the supercooled liquid refrigerant into the gas-liquid two-phase refrigerant with low temperature and low pressure. The gas-liquid two-phase refrigerant with low temperature and low pressure flows into the indoor heat exchanger 11 to evaporate and absorb heat. In the indoor heat exchanger 11, the refrigerant is evaporated into superheated gas again, and returned to a suction end of the compressor 22 to accomplish a cycle. In the case where the air conditioning system 1000 operates in the cooling mode, the flow direction of the refrigerant is shown by the solid arrows in FIG. 1.

As shown in FIG. 1, in the case where the air conditioning system 1000 operates in the heating mode, a gaseous refrigerant with high temperature and high pressure flowing through the four-way valve 23 and is directly discharged into the indoor heat exchanger 11 for heating. After being cooled into a supercooled liquid phase in the indoor heat exchanger 11, the supercooled liquid refrigerant flows into the throttling mechanism 25, and is throttled by the throttling mechanism 25 into the gas-liquid two-phase refrigerant with low temperature and low pressure. The gas-liquid two-phase refrigerant with low temperature and low pressure flows into the outdoor heat exchanger 21 for heat absorption and evaporation. In the case where the air conditioning system 1000 operates in the heating mode, the flow direction of the refrigerant is shown by the dashed arrows in FIG. 1.

Figure 2:
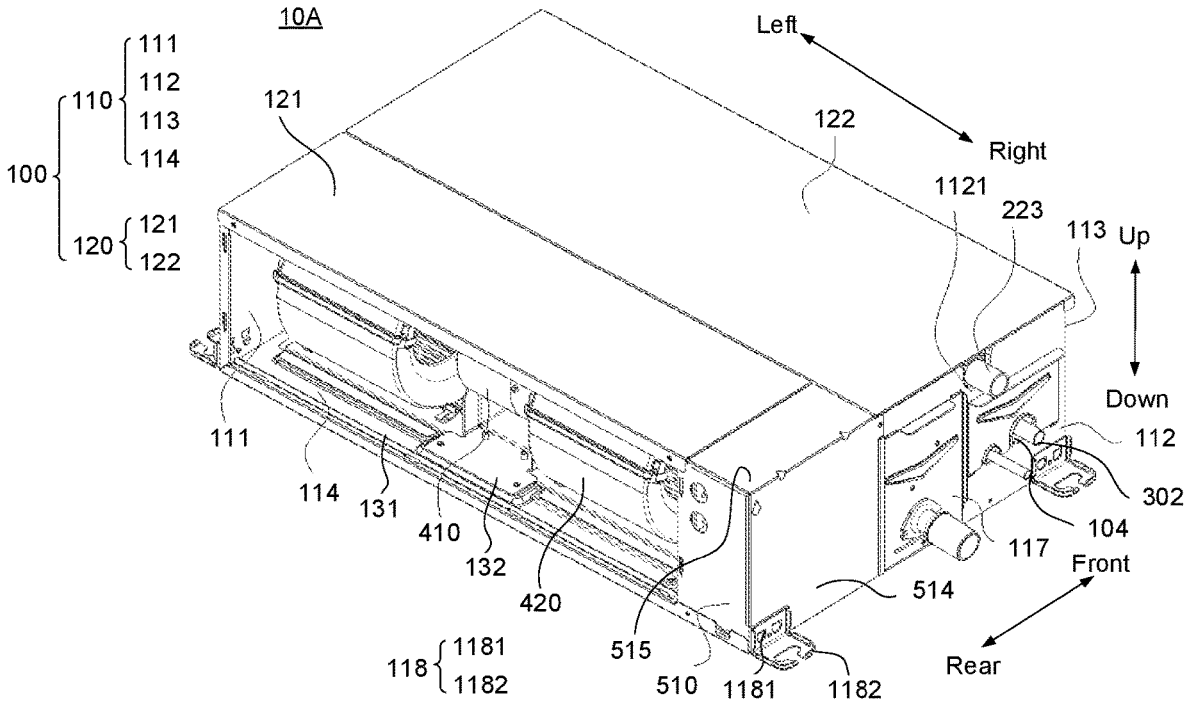
FIG. 2 is a perspective view of a ducted air conditioner, in accordance with some embodiments.
Figure 3:
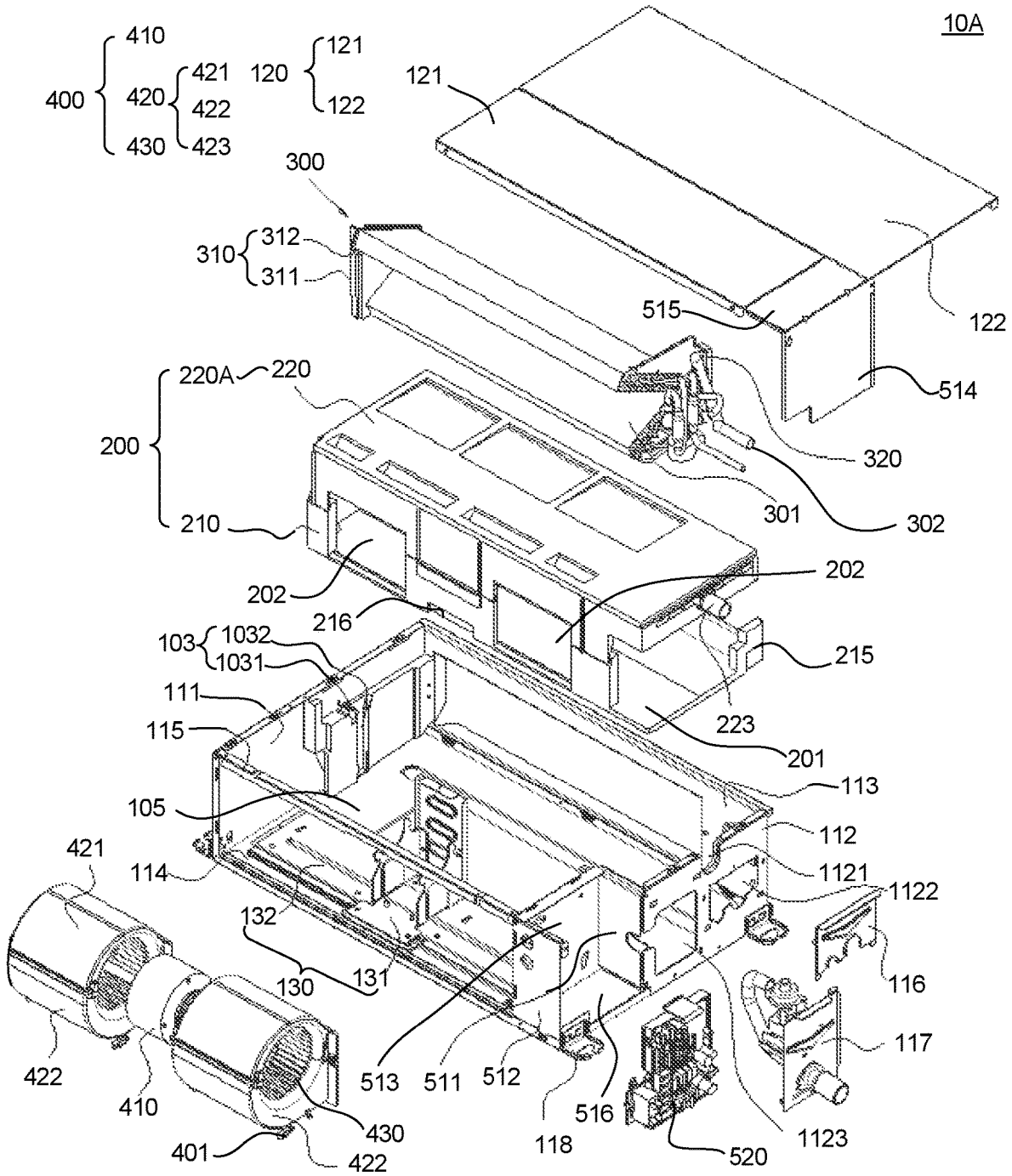
FIG. 3 is an exploded view of a ducted air conditioner, in accordance with some embodiments.

Some embodiments of the present disclosure provide a ducted air conditioner 10A, as shown in FIGS. 2 and 3, the ducted air conditioner 10A includes a housing 100, a heat-retaining and drainage assembly 200, an air conditioning device 300 (including the indoor heat exchanger 11), and a fan assembly 400.

In some embodiments, as shown in FIGS. 2 and 3, the housing 100 includes a box body 110 and a cover plate 120. The box body 110 has an opening 105, and the cover plate 120 is configured to close the opening 105.

For example, the cover plate 120 is fixedly connected to the box body 110 in a clamping manner. When necessary, the connection may be assisted through a small number of screws.

In some embodiments, as shown in FIGS. 2 and 3, the housing 100 has a substantially cuboid structure. The box body 110 includes a first side plate 111, a second side plate 112, a third side plate 113 and a bottom plate 114. The opening 105 is provided on a side of the box body 110 away from the bottom plate 114.

The first side plate 111, the second side plate 112 and the third side plate 113 are all connected to the bottom plate 114 and are located at a side of the bottom plate 114 proximate to the cover plate 120. The first side plate 111 is parallel to the second side plate 112, the first side plate 111 constitutes a left side wall of the housing 100 (a left-right direction as shown in FIG. 2), and the second side plate 112 constitutes a portion of a right side wall of the housing 100. Both ends of the third side plate 113 are connected to the first side plate 111 and the second side plate 112 respectively. For example, one end of the third side plate 113 is connected to a front edge of the first side plate 111 (a front direction as shown in FIG. 2), and another end of the third side plate 113 is connected to a front edge of the second side plate 112. The third side plate 113 constitutes a front side wall of the housing 100.

In some embodiments, as shown in FIGS. 2 and 3, the first side plate 111 and the bottom plate 114 are of a bent integral member. The second side plate 112 is connected to the bottom plate 114 in at least one of a clamping manner or a threading manner. For example, the second side plate 112 and the bottom plate 114 are connected by clamping, or the second side plate 112 and the bottom plate 114 are connected by threading, or the second side plate 112 and the bottom plate 114 are connected by clamping and threading.

In some embodiments, as shown in FIG. 3, the third side plate 113 and the first side plate 111, the third side plate 113 and the second side plate 112, and the third side plate 113 and the bottom plate 114 are all connected in the clamping manner.

In some embodiments, as shown in FIG. 3, the heat-retaining and drainage assembly 200 includes a first heat-retaining member 210 and a second heat-retaining member 220. The second heat-retaining member 220 is closer to the cover plate 120 than the first heat-retaining member 210. The first heat-retaining member 210 is connected to the second heat-retaining member 220, so as to divide an inner space of the housing 100 into independent first cavity 101 and second cavity 102 (referring to FIG. 4).

In some embodiments, as shown in FIGS. 2 and 3, the cover plate 120 includes a first sub-cover plate 121 and a second sub-cover plate 122. The first sub-cover plate 121 is connected to the second sub-cover plate 122 and is coplanar with the second sub-cover plate 122. The first sub-cover plate 121 is covered above the first cavity 101, and the second sub-cover plate 122 is covered above the second cavity 102.

Figure 7:
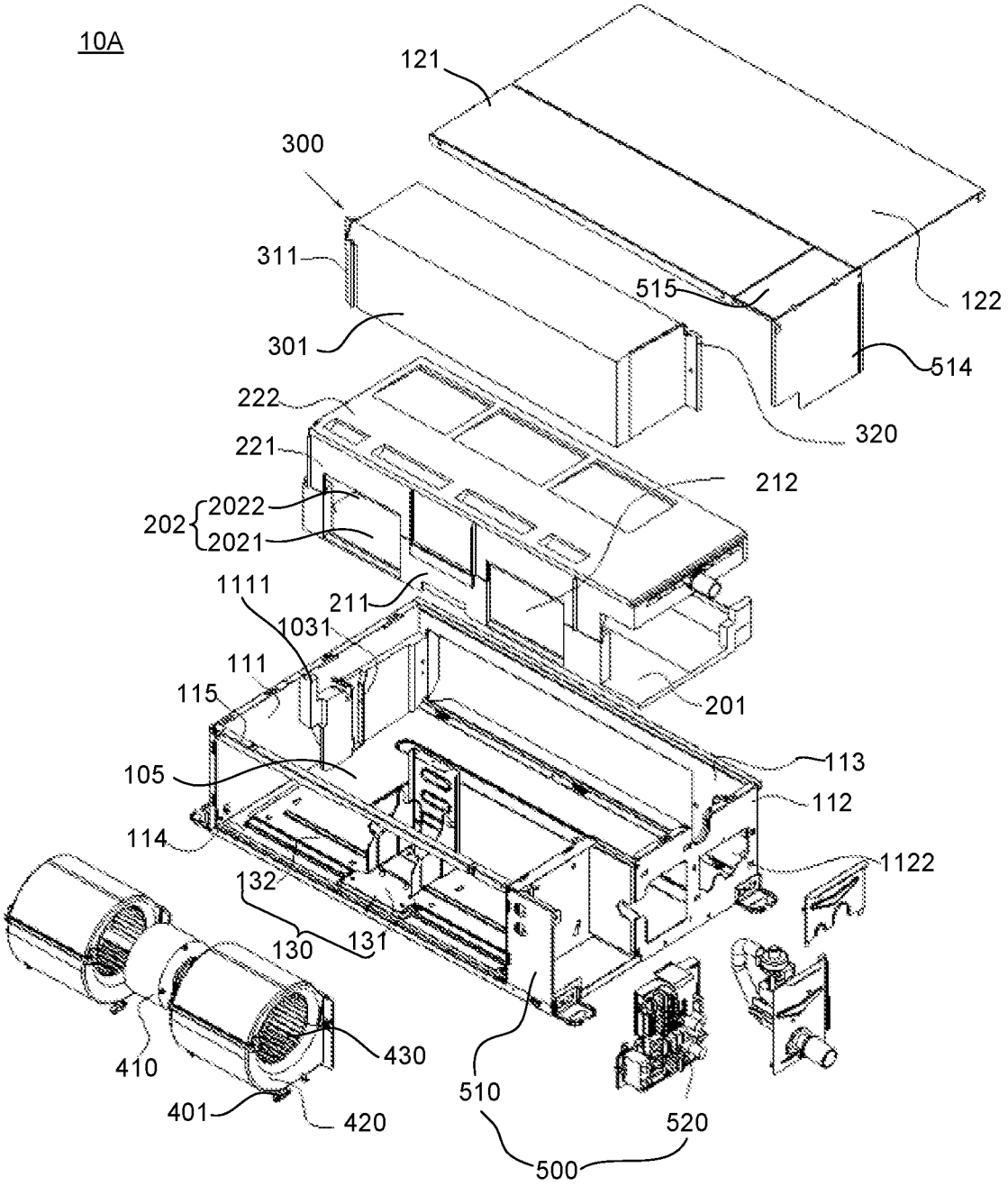
FIG. 7 is an exploded view of another ducted air conditioner, in accordance with some embodiments.

In some embodiments, as shown in FIGS. 3 and 7, the air conditioning device 300 includes an air conditioning assembly 301. The air conditioning assembly 301 may be one of a heat exchanger, a humidifier, an air purifier, or an electric heater. In a case where the air conditioning assembly 301 includes the heat exchanger, the second heat-retaining member 220 is configured as a drain pan 220A.

In some embodiments, the first heat-retaining member 210 is a foam member which is integrally formed, and is configured to insulate heat transfer between the housing 100 and an interior of the heat-retaining and drainage assembly 200.

In some embodiments, a length of the first heat-retaining member 210 is substantially equal to a length of the box body 110, and a front surface of the first heat-retaining member 210 abuts against the third side plate 113 of the box body 110.

The drain pan 220A is configured to receive condensed water generated in a case where the ducted air conditioner 10A is in a condition of refrigeration, and abuts against the first heat-retaining member 210. In some embodiments, the drain pan 220A is further configured to insulate heat transfer between the housing 100 and the interior of the heat-retaining and drainage assembly 200.

In some embodiments, as shown in FIG. 3, the first heat-retaining member 210 is connected to the drain pan 220A, so as to divide the inner space of the housing 100 to the above first cavity 101 and the second cavity 102.

Figure 4:
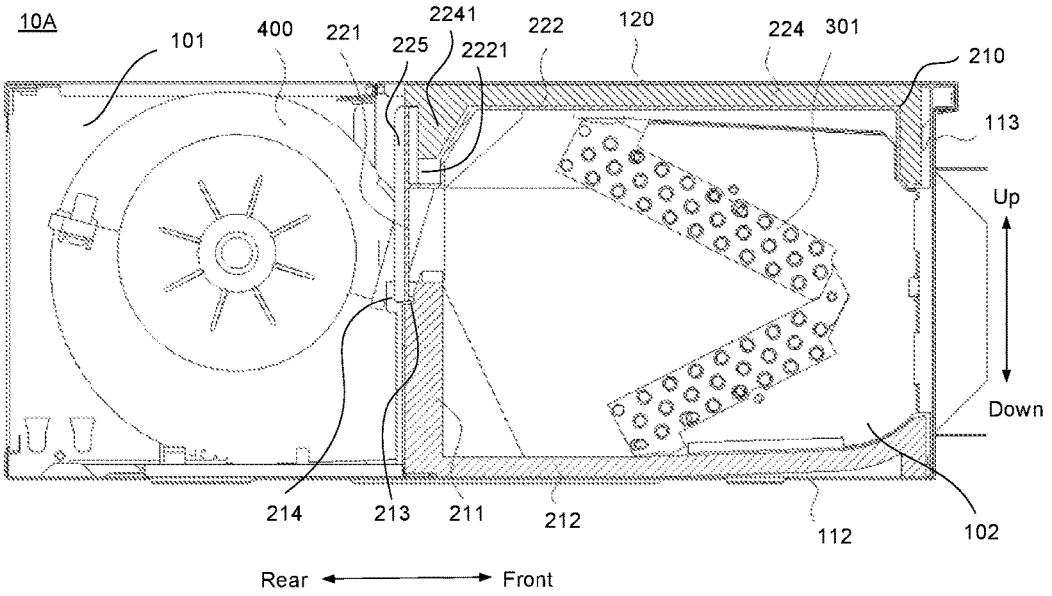
FIG. 4 is a sectional view of a ducted air conditioner, in accordance with some embodiments.

In some embodiments, as shown in FIGS. 3 and 4, the air conditioning device 300 is disposed in the second cavity 102 and located between the first heat-retaining member 210 and the drain pan 220A. The fan assembly 400 is disposed in the first cavity 101.

It can be understood that, the heat-retaining and drainage assembly 200 may maintain heat, receive condensed water, and may further isolate the fan assembly 400 from the air conditioning device 300. In this way, there is no need to provide a partition plate in the ducted air conditioner 10A, so that the number of components is reduced, a structure of the ducted air conditioner 10A is simplified, and a cost is reduced.

In some embodiments, a length of the drain pan 220A is substantially equal to the length of the first heat-retaining member 210 and is equal to the length of the box body 110.

In some embodiments, as shown in FIGS. 2, 3 and 7, the ducted air conditioner 10A further includes an electrical control assembly 500. The electrical control assembly 500 is disposed at an end of the first cavity 101 along a length direction (the left-right direction as shown in FIG. 2). The electrical control assembly 500 includes an electrical control box 510.

Figure 5:
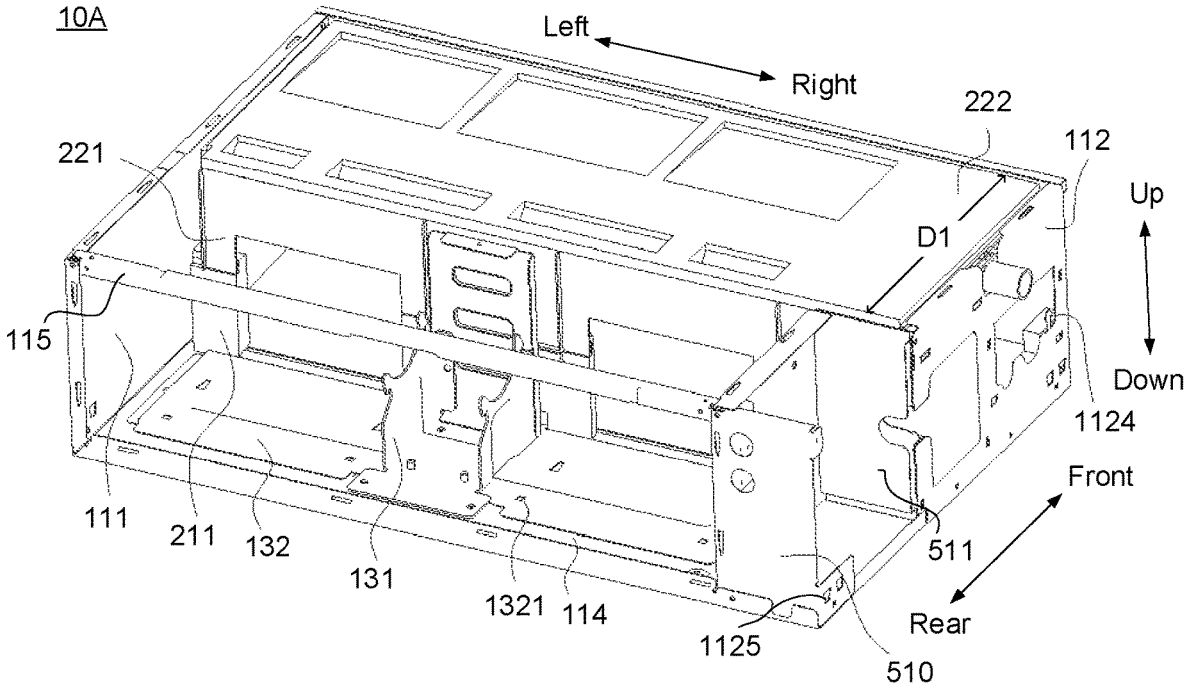
FIG. 5 is a perspective view of a ducted air conditioner with a cover plate removed, in accordance with some embodiments.

In some embodiments, referring to FIG. 3, the electrical control box 510 includes an electrical control box front side plate 511. A distance D1 (referring to FIG. 5) between the electrical control box front side plate 511 and the third side plate 113 is substantially equal to a dimension of the heat-retaining and drainage assembly 200 in a width direction of the box body 110 (a front-rear direction as shown in FIG. 5). In this way, it is convenient to install the heat-retaining and drainage assembly 200 in the box body 110.

In some embodiments, as shown in FIGS. 3 and 7, the electrical control assembly 500 further includes a controller 520. The controller 520 is disposed in the electrical control box 510 and is communicatively connected to the air conditioning device 300 and the fan assembly 400 respectively. The controller 520 is configured to receive detecting signals of the air conditioning device 300 and the fan assembly 400, and controls the air conditioning device 300 and the fan assembly 400 according to the detecting signals.

In some embodiments, as shown in FIGS. 2, 3 and 5, the electrical control box 510 further includes an electrical control box rear side plate 512, an electrical control box left side plate 513, an electrical control box right side plate 514, an electrical control box top plate 515 and an electrical control box bottom plate 516.

The electrical control box top plate 515 is coplanar with the cover plate 120, and jointly constitutes a top wall of the housing 100 with the cover plate 120.

The electrical control box bottom plate 516 is coplanar with the bottom plate 114, and jointly constitutes a bottom wall of the housing 100 with the bottom plate 114.

The electrical control box right side plate 514 is perpendicular to the electrical control box top plate 515, and is connected to an end (e.g., a right end) of the electrical control box top plate 515. The electrical control box right side plate 514 constitutes a right side wall of the electrical control box 510.

In some embodiments, the electrical control box right side plate 514 is coplanar with the second side plate 112, and jointly constitutes the right side wall of the housing 100 with the second side plate 112.

In some embodiments, the electrical control box front side plate 511, the electrical control box rear side plate 512, the electrical control box left side plate 513 and the electrical control box right side plate 514 are all clamped with the electrical control box bottom plate 516, and the electrical control box bottom plate 516 is clamped with the bottom plate 114. When necessary, the connection may be assisted through a small number of screws.

In some embodiments, as shown in FIG. 2, the electrical control box right side plate 514 is fixedly connected to the second side plate 112 in the clamping manner. When necessary, the connection may be assisted through a small number of screws.

In some embodiments, as shown in FIG. 5, the box body 110 further includes a cross beam 115, an end of the cross beam 115 is clamped to the first side plate 111, and another end of the cross beam 115 is clamped to the electrical control box left side plate 513. When necessary, the connection may be assisted through a small number of screws.

In some embodiments, as shown in FIG. 3, the heat-retaining and drainage assembly 200 further includes a weight-reducing hole 201, and the weight-reducing hole 201 is located at a position of the heat-retaining and drainage assembly 200 corresponding to the electrical control box front side plate 511. An orthogonal projection of the weight-reducing hole 201 on the electrical control box front plate 511 is located in the electrical control box front plate 511. In this way, materials may be saved and a cost of manufacturing the heat-retaining and drainage assembly 200 may be reduced.

In some embodiments, as shown in FIGS. 3 and 4, the first heat-retaining member 210 includes a first side wall 211 and a heat-retaining member bottom wall 212. The first side wall 211 is perpendicular to the heat-retaining member bottom wall 212 and is connected to an end of the heat-retaining member bottom wall 212, the first side wall 211 defines a first dividing plate. The drain pan 220A includes a drain pan side plate 221 and a drain pan bottom plate 222. The drain pan side plate 221 is perpendicular to the drain pan bottom plate 222 and is connected to an end of the drain pan bottom plate 222, the drain pan side plate 221 defines a second dividing plate.

In some embodiments, as shown in FIG. 4, ends of the first side wall 211 and the drain pan side plate 221 proximate to each other are connected in an abutting manner. In this way, the inner space of the housing 100 may be divided into the above first cavity 101 and the second cavity 102 by abutting of the first side wall 211 and the drain pan side plate 221.

In some embodiments, as shown in FIG. 4, the first heat-retaining member 210 further includes a step 213. The step 213 is located at an outer side of an upper end of the first side wall 211 (a rear side as shown in FIG. 4), and a lower end of the drain pan side plate 221 abuts against the step 213.

Figure 11:
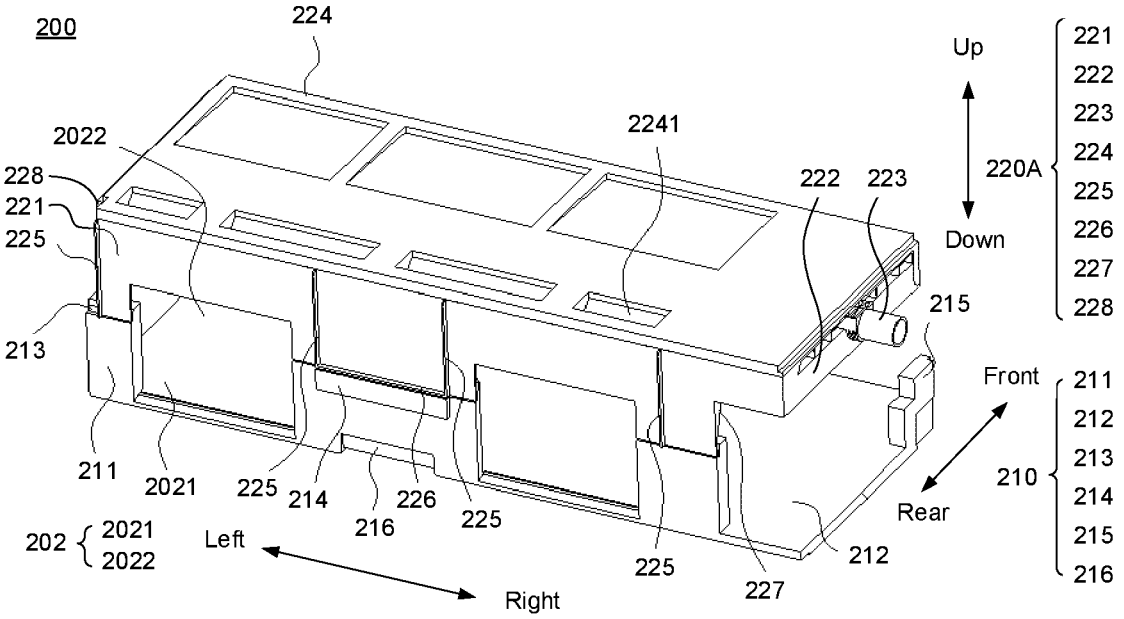
FIG. 11 is a perspective view of a heat-retaining and drainage assembly of a ducted air conditioner, in accordance with some embodiments.

In some embodiments, as shown in FIGS. 3 and 11, the first heat-retaining member 210 further includes a second side wall 215. The second side wall 215 is connected to an end of the heat-retaining member bottom wall 212 proximate to the second side plate 112 and is perpendicular to the heat-retaining member bottom wall 212. The second side wall 215 is connected to the second side plate 112.

For example, referring to FIGS. 3 and 5, the box body 110 further includes a pressing piece 1124. The pressing piece 1124 is disposed on the second side plate 112 and corresponds to a position of an edge (e.g., an upper edge) of the second side wall 215 away from the heat-retaining member bottom wall 212. The pressing piece 1124 is bendable. By bending the pressing piece 1124 to the top of the second side wall 215, and connecting the pressing piece 1124 to the second side wall 215, for example, in the clamping manner or the threading manner, the first heat-retaining member 210 may be limited between the pressing piece 1124 and the bottom plate 114 of the box body 110, which is conducive to improving a reliability of the connection between the first heat-retaining member 210 and the box body 110.

In some embodiments, as shown in FIGS. 3 and 7, the first heat-retaining member 210 includes a first opening 2021. The first opening 2021 is located at an edge of the first side wall 211 proximate to the drain pan side plate 221, and runs through the first side wall 211. A side of the first opening 2021 proximate to the drain pan side plate 221 is open.

The drain pan 220A includes a second opening 2022 corresponding to the first opening 2021. The second opening 2022 is located at an edge of the drain pan side plate 221 proximate to the first side wall 211, and runs through the drain pan side plate 221. A side of the second opening 2022 proximate to the first side wall 211 is open.

In some embodiments, as shown in FIG. 7, the second opening 2022 cooperates with the first opening 2021 to provide a vent 202. The second cavity 102 communicates with the first cavity 101 through the vent 202.

In some embodiments, the first sidewall 211 is provided with one or a plurality of first openings 2021, and a plurality of second openings 2022 and the plurality of first openings 2021 are arranged in a one-to-one correspondence manner.

In some embodiments, as shown in FIG. 3, the vent 202 is a rectangular hole.

In some embodiments, as shown in FIGS. 2, 3 and 11, the drain pan 220A further includes a water outlet pipe 223. The water outlet pipe 223 is disposed at an end of the drain pan 220A proximate to the second side plate 112. The second side plate 112 includes a water outlet pipe hole 1121. The water outlet pipe hole 1121 is located at an edge of the second side plate 112 proximate to the drain pan 220A. A side of the water outlet pipe hole 1121 facing the cover plate 120 is open and the water outlet pipe hole 1121 is matched with the water outlet pipe 223.

It can be understood that, the positioning and connecting speed of the drain pan 220A in the box body 110 may be improved by mounting the water outlet pipe 223 in the water outlet pipe hole 1121, thereby improving the assembly efficiency of the ducted air conditioner 10A.

Figure 12:
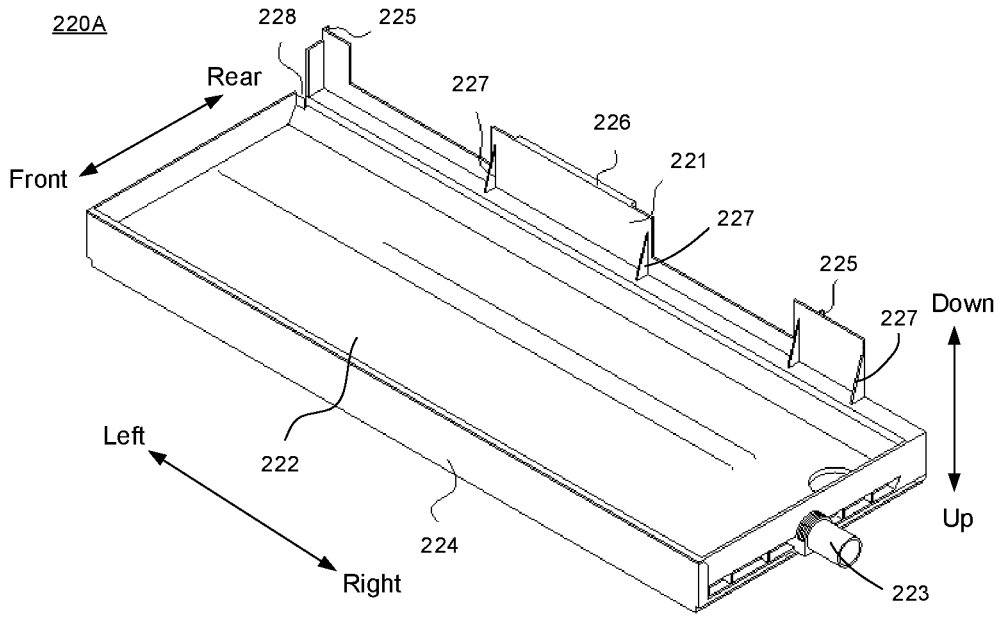
FIG. 12 is a perspective view of a drain pan of a ducted air conditioner, in accordance with some embodiments.

In some embodiments, as shown in FIGS. 11 and 12, the drain pan 220A further includes a first reinforcing rib 225. The first reinforcing rib 225 is disposed on a side of the drain pan side plate 221 away from the third side plate 113 and extends along a height direction (e.g., the upper-down direction) of the drain pan side plate 221. A length of the first reinforcing rib 225 is substantially equal to a height of the drain pan 220A. In this way, a structural strength of the drain pan side plate 221 may be improved by providing the first reinforcing rib 225, which is conducive to improving a connection reliability of abutment between the drain pan side plate 221 and the first side wall 211.

In some embodiments, as shown in FIGS. 11 and 12, the drain pan 220A includes one or a plurality of first reinforcing ribs 225. The plurality of first reinforcing ribs 225 are arranged at an interval along a length direction (e.g., the left-right direction) of the drain pan side plate 221.

In some embodiments, as shown in FIGS. 11 and 12, the drain pan 220A further includes a second reinforcing rib 226. The second reinforcing rib 226 and the first reinforcing rib 225 are disposed on a same side of the drain pan side plate 221. The second reinforcing rib 226 is located at an edge (e.g., a lower edge) of the drain pan side plate 221 proximate to the first side wall 211, and extends along a length direction of the drain pan side plate 221. In this way, a width of a lower edge of the drain pan side plate 221 may be increased by providing the second reinforcing rib 226 (e.g., a dimension in the front-rear direction), thereby increasing an abutting area between the drain pan side plate 221 and the first side wall 211. In addition, the second reinforcing rib 226 further abuts against the step 213, so that it is possible to reduce the difficulty in connecting the first side wall 211 to the drain pan side plate 221.

In some embodiments, as shown in FIG. 11, both ends of the second reinforcing ribs 226 are respectively connected to lower ends of two first reinforcing ribs 225, so as to improve a strength of the drain pan side plate 221.

In some embodiments, as shown in FIGS. 11 and 12, the drain pan 220A further includes a third reinforcing rib 227. The third reinforcing rib 227 is disposed on a side of the drain pan side plate 221 proximate to the third side plate 113 and extends along the height direction of the drain pan side plate 221. One end (e.g., an upper end) of the third reinforcing rib 227 is connected to the drain pan bottom plate 222, and another end (e.g., a lower end) of the third reinforcing rib 227 extends to a lower edge of the drain pan side plate 221.

In some embodiments, as shown in FIGS. 11 and 12, the third reinforcing rib 227 is a variable-section reinforcing rib. A dimension of the variable-section reinforcing rib in a width direction of the drain pan 220A gradually decreases from the one end to the another end (e.g., from top to bottom). In this way, a strength of a connection between the drain pan side plate 221 and the drain pan bottom plate 222 may be improved.

In some embodiments, as shown in FIGS. 11 and 12, the drain pan 220A includes one or a plurality third reinforcing ribs 227. The plurality of third reinforcing ribs 227 are arranged at an interval along the length direction (e.g., the left-right direction) of the drain pan side plate 221.

In some embodiments, the first reinforcing rib 225, the second reinforcing rib 226, and the third reinforcing rib 227 are integrally formed with the drain pan side plate 221.

In some embodiments, as shown in FIGS. 4, 11 and 12, the drain pan 220A further includes a heat insulating layer 224. The heat insulating layer 224 is disposed on a side of the drain pan bottom plate 222 away from the heat-retaining member bottom wall 212, and is fixedly connected to the drain pan bottom plate 222. The heat insulating layer 224 is an integral member, and is configured to insulate heat transfer between the drain pan bottom plate 222 and the cover plate 120.

In some embodiments, the heat insulating layer 224 is bonded to the drain pan bottom plate 222.

In some embodiments, as shown in FIGS. 4 and 11, the drain pan bottom plate 222 has a third groove 2221. The third groove 2221 is located at a side of the drain pan bottom plate 222 proximate to the heat insulating layer 224. The third groove 2221 extends along the length direction of the drain pan bottom plate 222, and is recessed in a direction away from the heat insulating layer 224. A side of the heat insulating layer 224 proximate to the drain pan bottom plate 222 is provided with a first protruding portion 2241, and the first protruding portion 2241 matches with the third groove 2221. The first protruding portion 2241 is bonded to the third groove 2221.

In some embodiments, as shown in FIG. 4, the third groove 2221 is configured to increase in dimension in a direction from an end proximate to the first heat-retaining member 210 to an end away from the first heat-retaining member 210. For example, a distance between two opposite side walls on a cross section of the third groove 2221 gradually increases in a direction from bottom to top.

In some embodiments, the cross section of the first protruding portion 2241 is a right-angled trapezoid. The third groove 2221 includes a right-angled trapezoidal groove matched with the first protruding portion 2241. A vertical surface where a right-angle side of the third groove 2221 is located is bonded to a vertical surface where a right-angle side of the first protruding portion 2241 is located. A sloping surface where a sloping side of the third groove 2221 is located has a guiding effect on an installation of the first protruding portion 2241, which is conducive to improving a mounting efficiency of the drain pan 220A.

In some embodiments, as shown in FIG. 4, a vertical side wall where the right-angle side of the third groove 2221 is located is a portion of the drain pan side plate 221. The heat insulating layer 224 extends to a front side of the drain pan 220A and abuts against the third side plate 113.

It can be understood that, in a case where the heat insulating layer 224 abuts against the third side plate 113, the third side plate 113 applies a first force on the heat insulating layer 224 in the width direction of the box body 110. The heat insulating layer 224 is an integral member, therefore, the first force will be transmitted to the drain pan side plate 221 through the first protruding portion 2241, so that the drain pan side plate 221 will apply a second force on the first protruding portion 2241. A direction of the second force is opposite to a direction of the first force. The heat insulating layer 224 is clamped between the third side plate 113 and the drain pan side plate 221, which is conducive to improving a stability of the connection between the drain pan 220A and the heat insulating layer 224.

In addition, since the drain pan side plate 221 has a vertical plate-shaped structure, and a surface of the first protruding portion 2241 in contact with the drain pan side plate 221 is a vertical surface. Therefore, the first protruding portion 2241 is not easy to disengage from the third groove 2221, thereby increasing a reliability of the connection between the drain pan bottom plate 222 and the heat insulating layer 224.

In some embodiments, as shown in FIGS. 11 and 12, the drain pan 220A further includes a first positioning hole 228. The first positioning hole 228 is disposed at an end of the drain pan 220A proximate to the first side plate 111, and runs through the drain pan 220A along the height direction of the drain pan 220A.

As shown in FIG. 7, the first side plate 111 includes a first positioning column 1111, the first positioning column 1111 is disposed on a side of the first side plate 111 proximate to the second side plate 112 and extends along a height direction of the first side plate 111. The first positioning column 1111 is matched with the first positioning hole 228. In this way, the drain pan 220A may be positioned by the cooperation between the first positioning column 1111 and the first positioning hole 228, which is conducive to improving the mounting efficiency and mounting reliability of the drain pan 220A.

Figure 6:
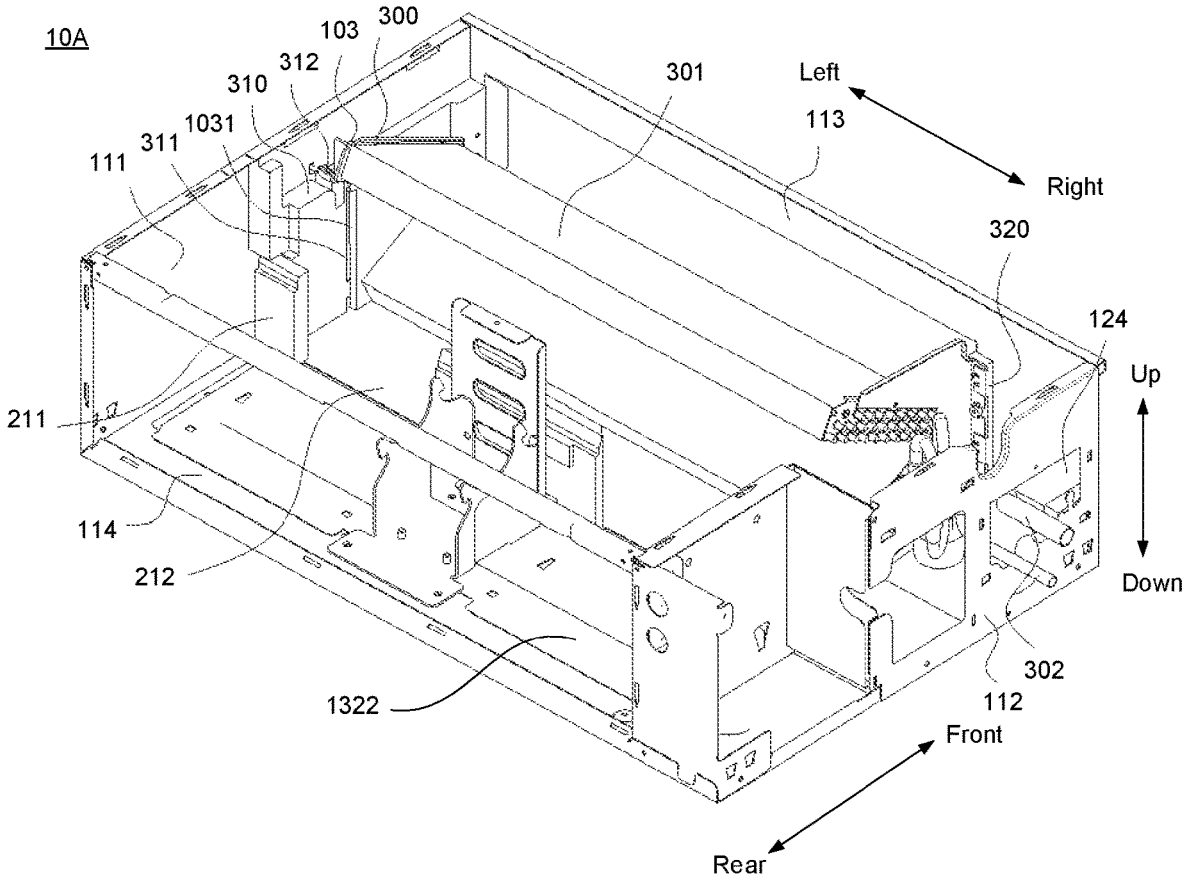
FIG. 6 is a perspective view of a ducted air conditioner with a drain pan removed, in accordance with some embodiments.

In some embodiments, as shown in FIGS. 3 and 6, the air conditioning device 300 includes an air conditioning assembly 301, a first fixing member 310 and a second fixing member 320.

In some examples, as shown in FIG. 3, the air conditioning assembly 301 has a piping 302. The piping 302 is located at an end of the air conditioning assembly 301 proximate to the second side plate 112. The piping 302 is configured to connect the outdoor unit 20.

In some embodiments, as shown in FIGS. 2, 3 and 6, the box body 110 further includes a box fixing member 103 and a pipe mounting hole 104. The box fixing member 103 is disposed on a surface of the first side plate 111 proximate to the second side plate 112, and is located in the second cavity 102. The box fixing member 103 is fixedly connected to the first side plate 111. At least a portion of the piping mounting hole 104 is disposed on the second side plate 112. The air conditioning assembly 301 may be positioned in the second cavity 102 by inserting the piping 302 in the piping mounting hole 104.

In some embodiments, as shown in FIGS. 2 and 3, the box body 110 further includes a piping cover plate 116. The second side plate 112 includes a first mounting groove 1122, the first mounting groove 1122 runs through the second side plate 112 along a thickness direction of the second side plate 112, and the first mounting groove 1122 is closer to the bottom plate 114 than the water outlet pipe hole 1121. The piping cover plate 116 is embedded in the first mounting groove 1122, so as to jointly define the piping mounting hole 104 with the second side plate 112.

In some embodiments, as shown in FIGS. 2 and 3, the box body 110 further includes a drain pipe assembly 117. The drain pipe assembly 117 may be connected to a water pump, and may drain the condensed water in the drain pan 220A through the water pump. The second side plate 112 includes a second mounting groove 1123, the second mounting groove 1123 runs through the second side plate 112 in the thickness direction of the second side plate 112, and the second mounting groove 1123 is located at a side of the first mounting groove 1122 away from the third side plate 113. The drain pipe assembly 117 is embedded in the second mounting groove 1123.

In some embodiments, referring to FIGS. 3 and 6, the first fixing member 310 is connected to the air conditioning assembly 301 and is located at the end of the air conditioning assembly 301 proximate to the first side plate 111. The first fixing member 310 is configured to cooperate with the box fixing member 103, so as to preliminarily fix the air conditioning assembly 301 in the second cavity 102.

Referring to FIGS. 3 and 6, the second fixing member 320 is connected to the air conditioning assembly 301 and is located at the end of the air conditioning assembly 301 proximate to the second side plate 112. The second fixing member 320 is fixedly connected to the third side plate 113 and is configured to fix the air conditioning assembly 301 in the second cavity 102.

Figure 8:
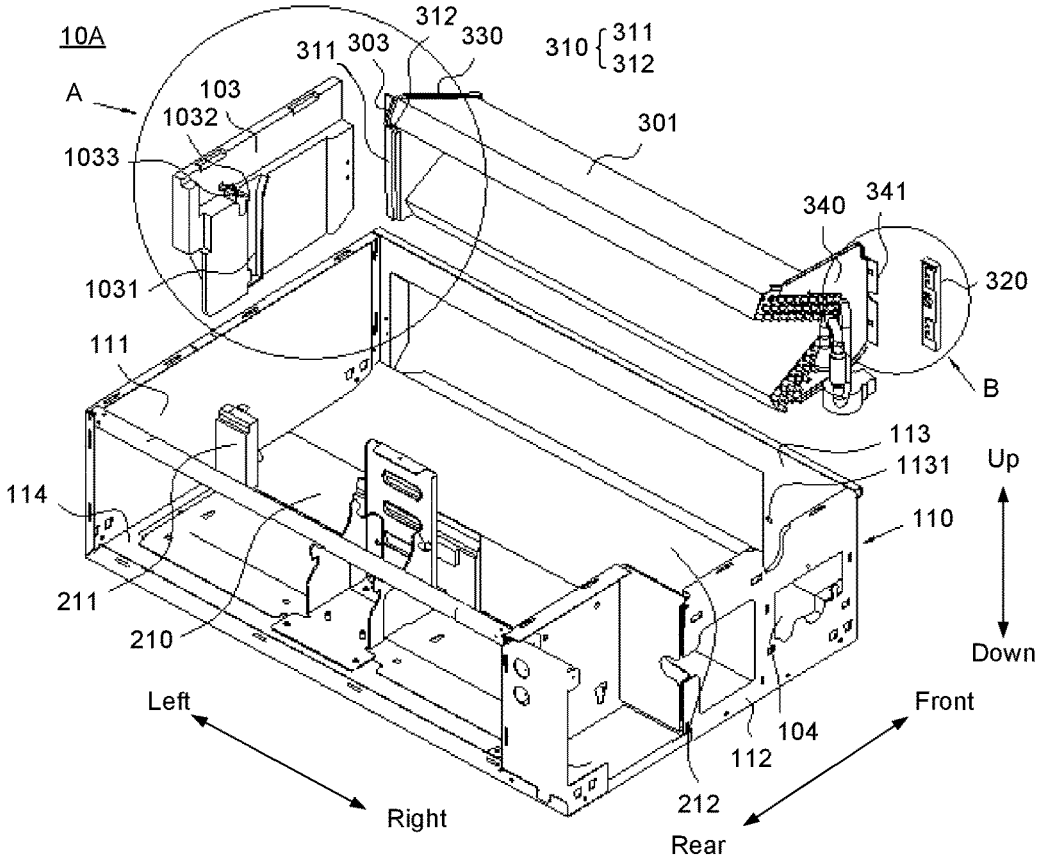
FIG. 8 is an exploded view of a local structure of a ducted air conditioner, in accordance with some embodiments.
Figure 9:
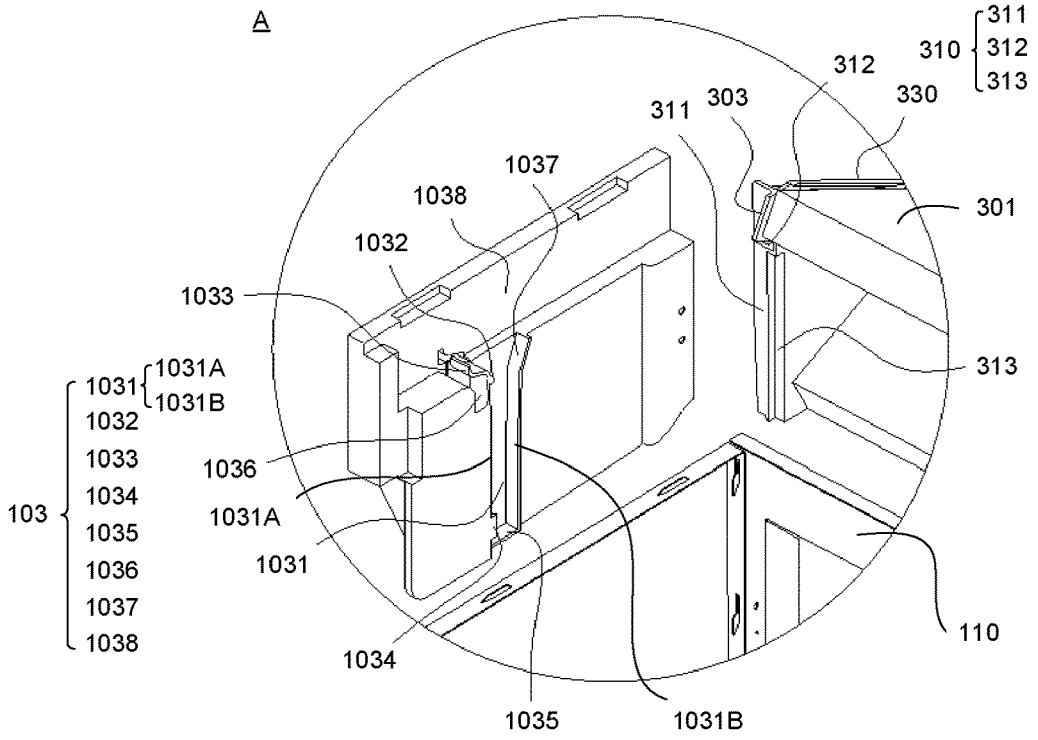
FIG. 9 is a partial enlarged view of circle A in FIG. 8.
Figure 10:
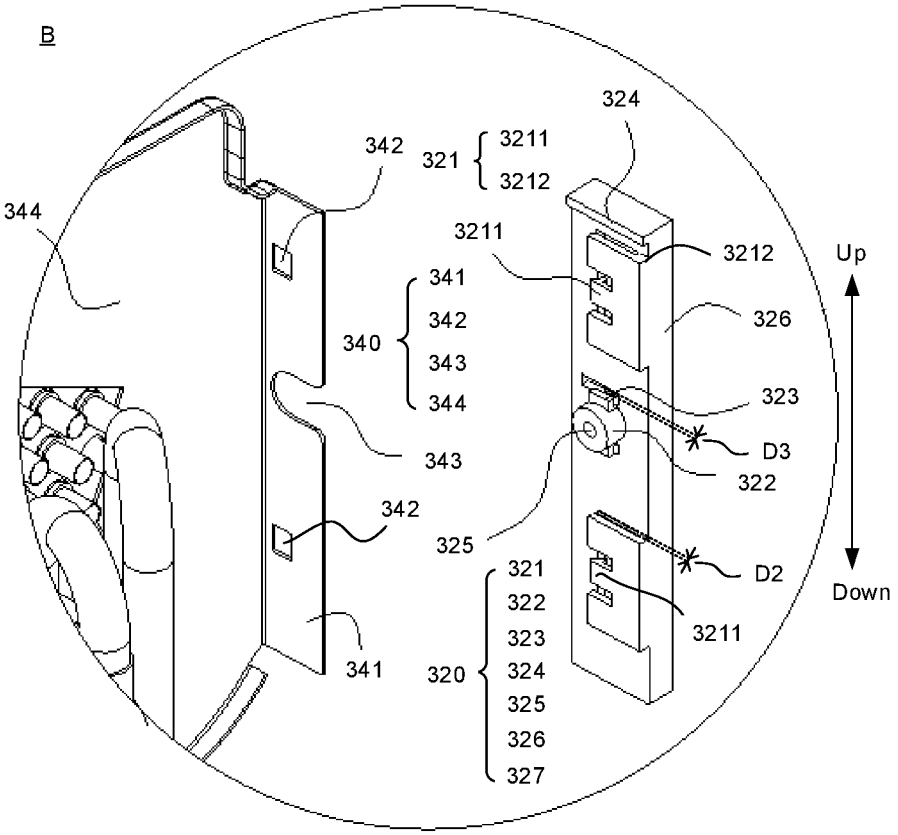
FIG. 10 is a partial enlarged view of circle B in FIG. 8.

In some embodiments, as shown in FIGS. 8 to 10, the air conditioning device 300 further includes a first end plate 330 and a second end plate 340. The first end plate 330 is located at the end of the air conditioning assembly 301 proximate to the first side plate 111 and is fixedly connected to the air conditioning assembly 301. The second end plate 340 is located at the end of the air conditioning assembly 301 proximate to the second side plate 112 and is fixedly connected to the air conditioning assembly 301.

In some embodiments, as shown in FIGS. 8 to 10, the first fixing member 310 is fixedly connected to the first end plate 330 through screws. The second fixing member 320 is clamped with the second end plate 340.

In some embodiments, as shown in FIGS. 8 and 9, the box fixing member 103 includes a box fixing member body 1038, a slideway 1031 and a first buckle 1032. The slideway 1031 is disposed on a surface of the box fixing body 1038 proximate to the second side surface 112. The first buckle 1032 is disposed on an inner side wall of the slideway 1031.

Referring to FIG. 9, the first fixing member 310 includes a slide rail 311 and a first clamping groove 312. The slide rail 311 is slidably connected to the slideway 1031. The first clamping groove 312 is clamped to the first buckle 1032. In a case where the slide rail 311 slides to an end (e.g., a lower end) of the slideway 1031, the first clamping groove 312 is engaged with the first buckle 1032. Thus, the fixed connection between the first fixing member 310 and the box fixing member 103 is achieved, and the connection between the air conditioning assembly 301 and the box body 110 is further achieved, so that the air conditioning assembly 301 is preliminarily fixed in the second cavity 102.

In some embodiments, as shown in FIGS. 8 and 9, the slideway 1031 is a groove extending along a height direction of the box body 110. The slideway 1031 includes a first slideway wall 1031A and a second slideway wall 1031B. The first slideway wall 1031A and the second slideway wall 1031B respectively constitute two sidewalls of the groove, and the second slideway wall 1031B is closer to the third side plate 113 than the first slideway wall 1031A.

In some embodiments, as shown in FIG. 9, an end of the first slideway wall 1031A away from the bottom plate 114 is a free end (e.g., an upper end). The first buckle 1032 is disposed on the free end of the first slideway wall 1031A, and is located at a side of the first slideway wall 1031A proximate to the second slideway wall 1031B.

In some embodiments, as shown in FIG. 9, the free end of the slideway 1031 is provided with a flared portion 1037. The flared portion 1037 is configured to gradually increase in dimension in a direction from an end proximate to the bottom plate 114 to an end away from the bottom plate 114. For example, the flared portion 1037 may be a variable-section groove provided on the box fixing member 103, and a distance between two side walls of the variable-section groove gradually increases in the direction from bottom to top. In this way, when the slide rail 311 is mounted with the slideway 1031, the flared portion 1037 may guide the slide rail 311, which is conducive to improving a mounting efficiency of the slideway 1031 and the slide rail 311.

In some embodiments, as shown in FIG. 9, the box fixing member 103 further includes a handle 1033. The handle 1033 is disposed on the free end of the first slideway wall 1031A, and is connected to the first buckle 1032. When disassembling the air conditioning assembly 301, the first buckle 1032 may be disengaged from the first clamping groove 312 by pulling the handle 1033, which is conducive to disassembling the air conditioning assembly 301.

In some embodiments, as shown in FIG. 9, the handle 1033 has an arc-shaped structure extending from the free end of the slideway 1031 to an outside of the slideway 1031, so as to facilitate the operation.

In some embodiments, as shown in FIG. 9, the box fixing member 103 further includes a baffle 1034. The baffle 1034 is disposed at a position proximate to the second side plate 112 of the first sildeway wall 1031A or the second sildeway wall 1031B. The baffle 1034 may limit the slide rail 311, so as to limit the slide rail 311 in the slideway 1031 reliably and prevent the slide rail 311 from disengaging from the slideway 1031.

In some embodiments, as shown in FIG. 9, the first fixing member 310 further includes a first groove 313. The first groove 313 is disposed on a side of the slide rail 311 proximate to the second side plate 112. The first groove 313 extends in a same direction as the slide rail 311, and a length of the first groove 313 is substantially equal to a length of the slide rail 311. When the slide rail 311 slides in the slideway 1031, the baffle 1034 is relatively slidable in the first groove 313.

In some embodiments, the box fixing member 103 further includes a limiting plate 1035. The limiting plate 1035 is disposed at the end (e.g., the lower end) of the slideway 1031 proximate to the bottom plate 114, and is respectively connected to the first sildeway wall 1031A and the second sildeway wall 1031B. In a case where the slide rail 311 slides to the lower end of the slideway 1031, the slide rail 311 may be limited by the limiting plate 1035, thereby preventing the slide rail 311 from disengaging from the slideway 1031.

In some embodiments, as shown in FIG. 9, the box fixing member 103 further includes a second groove 1036. The second groove 1036 is located at a side of the first buckle 1032 away from the second sildeway wall 1031B. In this way, when disassembling the air conditioning assembly 301, the second groove 1036 may provide sufficient space for the moving of the first buckle 1032, so that the first buckle 1032 may be disengaged from the first clamping groove 312.

In some embodiments, as shown in FIGS. 8 and 9, the air conditioning device 300 further includes a knob 303. The knob 303 is disposed at the end of the air conditioning assembly 301 proximate to the first side plate 11 and is fixedly connected to the air conditioning assembly 301. In this way, when the operator installs the air conditioning assembly 301, the operator may control the air conditioning assembly 301 by holding the knob 303, so that the slide rail 311 may slide into the slideway 1031 smoothly, which is conducive to improving a mounting efficiency of the air conditioning device 300.

In some embodiments, as shown in FIG. 9, the knob 303 is located at a side of the first fixing member 310 away from the third side plate 113 and is fixedly connected to the first fixing member 310.

In some embodiments, as shown in FIG. 10, the second end plate 340 includes an end plate body 344, a first fixing plate 341 and a second clamping groove 342. The end plate body 344 is fixedly connected to the air conditioning assembly 301. The first fixing plate 341 is connected to an end of the end plate body 344 proximate to the third side plate 113, and the first fixing plate 341 is perpendicular to the end plate body 344.

Referring to FIG. 10, the second clamping groove 342 is disposed on the first fixing plate 341 and runs through the first fixing plate 341 along a thickness direction of the first fixing plate 341. In some embodiments, the second end plate 340 includes one or a plurality of second clamping grooves 342. The plurality of second clamping grooves 342 are disposed on the first fixing plate 341 at an interval along a length direction of the first fixing plate 341 (e.g., the up-down direction as shown in FIG. 10).

In some embodiments, as shown in FIG. 10, the second fixing member 320 includes a second fixing plate 326 and a second buckle 321. The second fixing plate 326 has a flat plate-shaped structure, and the second buckles 321 are disposed on the second fixing plate 326 and are clamped with the second clamping grooves 342 in a one-to-one correspondence manner. The fixed connection between the first fixing plate 341 and the second fixing plate 326 may be achieved by the clamping of the second buckle 321 and the second clamping groove 342.

In some embodiments, as shown in FIG. 10, the second buckle 321 includes a buckling portion 3211 and a connecting portion 3212.

The buckling portion 3211 is parallel to the second fixing plate 326 and located at a side of the second fixing plate 326 proximate to the first fixing plate 341. The connecting portion 3212 connects the second fixing plate 326 and the buckling portion 3211.

The connecting portion 3212 is configured to space a distance D2 (referring to FIG. 10) between the buckling portion 3211 and the second fixing plate 326. The distance D2 is substantially equal to a thickness of the first fixing plate 341.

In this way, in a case where the second buckle 321 is clamped to the second clamping groove 342, the first fixing plate 341 is located between the buckling portion 3211 and the second fixing plate 326, so that the connection between the second end plate 340 and the second fixing member 320 is more stable.

In some embodiments, as shown in FIG. 10, the second end plate 340 further includes a third opening 343. The third opening 343 runs through the first fixing plate 341 along a thickness direction of the first fixing plate 341, and a position of the third opening 343 away from the end plate body 344 is open.

For example, the third opening 343 may be located at a middle position of the first fixing plate 341 along a length direction. The second end plate 340 includes two second clamping grooves 342, and the third opening 343 is located between the two second clamping grooves 342. However, the present disclosure is not limited thereto.

The second fixing member 320 further includes a fixing column 322. The fixing column 322 and the second buckle 321 are located at the same side of the second fixing plate 326. A quick positioning between the second buckle 321 (e.g., the buckling portion 3211) and the second clamping groove 342 may be achieved by a cooperation between the fixing column 322 and the third opening 343, which is conducive to improving the mounting efficiency of the air conditioning device 300.

In some embodiments, as shown in FIG. 10, the second fixing member 320 further includes a clip 323. The clips 323 are arranged in pairs on opposite sides of the fixing column 322, and an arrangement direction of the two clips 323 is parallel to an extending direction of the second fixing plate 326. The clip 323 is spaced apart from the second fixing plate 326 by a distance D3 (referring to FIG. 10), in a case where the fixing column 322 is located in the third opening 343, the first fixing plate 341 is located between the clip 323 and the second fixing plate 326, which is conducive to improving a stability of the connection between the first fixing plate 341 and the second fixing plate 326.

In some embodiments, the second fixing member 320 further includes a limiting bar 324. The limiting bar 324 is located at an end (e.g., an upper end) of the second fixing plate 326 away from the bottom plate 114 and extends along a length direction of the bottom plate 114. The limiting bar 324 is configured to limit the first fixing plate 341, so that the connection between the second buckle 321 and the second clamping groove 342 is more convenient, which is conducive to improving the mounting efficiency of the air conditioning device 300.

In some embodiments, as shown in FIGS. 8 and 10, the second fixing member 320 further includes a first screw hole 325. The third side plate 113 is provided with a second screw hole 1131 (referring to FIG. 8) at a position corresponding to the first screw hole 325. A screw is inserted through the first screw hole 325 and the second screw hole 1131 to fixedly connect the second fixing member 320 and the third side plate 113, so that the fixed connection between the air conditioning assembly 301 and the box body 110 may be achieved.

In some embodiments, as shown in FIG. 10, the second fixing member 320 includes one first screw hole 325. The first screw hole 325 runs through the fixing column 322 and the second fixing plate 326 along an extending direction of the fixing column 322. In this way, a length of the first screw hole 325 may be increased, which is conducive to improving the connection stability between the air conditioning assembly 301 and the box body 110.

In some embodiments, the second fixing member 320 includes a plurality of first screw holes 325, and the third side plate 113 includes a plurality of second screw holes 1131 in one-to-one correspondence with the plurality of first screw holes 325. The screw is inserted through each of the first screw holes 325 and the corresponding second screw hole 1131, so as to further improve the connection stability between the air conditioning assembly 301 and the box body 110.

In some embodiments, the box fixing member 103, the first fixing member 310 and the second fixing member 320 are all rubber member or plastic member. The rubber member and the plastic member are capable of preserving heat, so that the heat or cold of the air conditioning assembly 301 is hardly transferred to the housing 100 (e.g., a metal member), thereby reducing heat loss, facilitating energy saving, and reducing power consumption of the ducted air conditioner 10A.

In some embodiments, the air conditioning assembly 301 has a second positioning column, and the box body 110 includes a second positioning hole matched with the second positioning column. It is convenient to limit the air conditioning assembly 301 through a cooperation of the second positioning column and the second positioning hole, which is conducive to improving the mounting efficiency of the air conditioning device 300.

In some embodiments, as shown in FIGS. 3 to 5, the housing 110 further includes a fan mounting assembly 130. The fan mounting assembly 130 includes a motor mounting frame 131 and a mounting plate 132. The mounting plate 132 is closer to the bottom plate 114 than the motor mounting frame 131. Both the motor mounting frame 131 and the mounting plate 132 are fixedly connected to the bottom plate 114 by screws. In addition, the motor mounting frame 131 is further fixedly connected to the mounting plate 132 by screws.

In some embodiments, the mounting plate 132 may also be fixedly connected to the bottom plate 114 in a riveting manner.

In some embodiments, the mounting plate 132 includes a third positioning column. The third positioning column protrudes in a direction toward the cover plate 120. The motor mounting frame 131 includes a third positioning hole matched with the third positioning column. It is conducive to improving a mounting efficiency of the motor mounting frame 131 and the mounting plate 132 through a cooperation between the third positioning column and the third positioning hole.

In some embodiments, as shown in FIGS. 3 and 7, the fan assembly 400 includes a motor 410, a volute 420 and a fan 430. The motor 410 is connected to the fan 430, so as to drive the fan 430 to rotate. The motor 410 is fixedly mounted on the motor mounting frame 131. The volute 420 is fixedly connected to the box body 110 in, for example, the clamping manner. The fan 430 is disposed in the volute 420.

Figure 13:
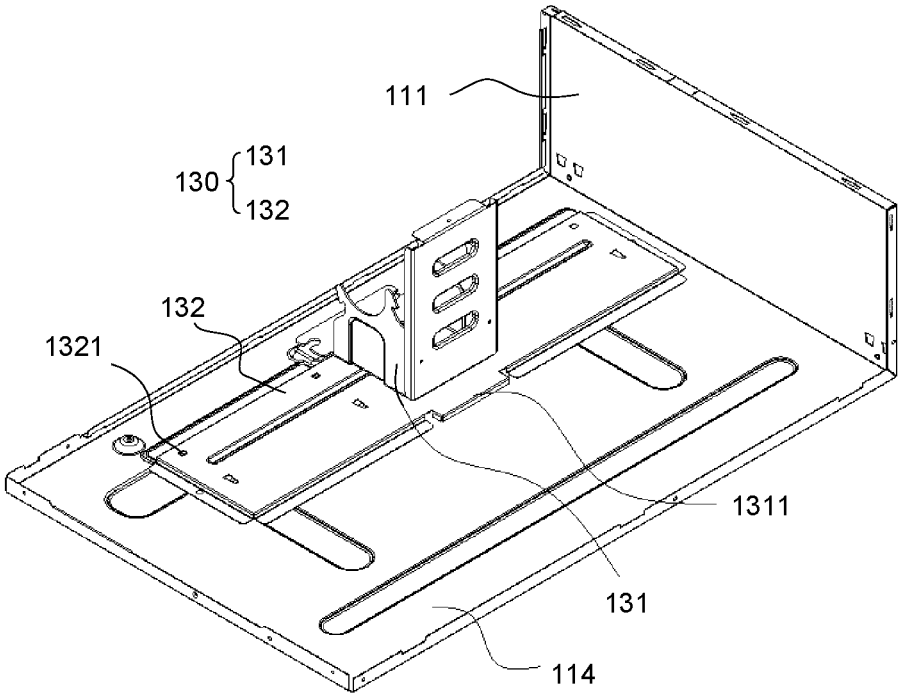
FIG. 13 is a perspective view of a fan mounting assembly and a bottom wall of a ducted air conditioner, in accordance with some embodiments.

In some embodiments, as shown in FIGS. 11 and 13, the first heat-retaining member 210 further includes a square-shaped recess 216. The recess 216 is disposed at a position where the first side wall 211 and the heat-retaining member bottom wall 212 are connected along a length direction of the first heat-retaining member 210.

Referring to FIG. 13, the motor mounting frame 131 includes a second protruding portion 1311 (i.e., a protruding portion). The second protruding portion 1311 is matched with the recess 216. In a case where the first heat-retaining member 210 is installed in the box body 110, the second protruding portion 1311 is located in the recess 216. In this way, the first heat-retaining member 210 may be quickly positioned in the box body 110, which is conducive to improving a mounting efficiency of the first heat-retaining member 210.

In some embodiments, as shown in FIGS. 3 and 11, the recess 216 is located at a middle of the position where the first side wall 211 and the heat-retaining member bottom wall 212 are connected. In this way, it is conducive to preventing the first heat-retaining member 210 from being displaced due to deformation. In some embodiments, the second protruding portion 1311 may also be directly disposed on the bottom plate 114.

In some embodiments, as shown in FIG. 3, the fan assembly 400 includes two volutes 420, and the motor 410 has two motor shafts. The motor 410 drives the fan 430 in the corresponding volute 420 through the corresponding motor shaft. Correspondingly, the heat-retaining and drainage assembly 200 includes two vents 202, and each vent 202 corresponds to one fan 430.

In some embodiments, as shown in FIGS. 3 and 5, a surface of the mounting plate 132 away from the bottom plate 114 is provided with a groove. An opening of the groove faces the cover plate 120. An inner bottom surface of the groove is provided with a bayonet 1321. In some embodiments, the mounting plate 132 includes a plurality of bayonets 1321.

In some embodiments, as shown in FIGS. 5 and 6, the mounting plate 132 includes the bayonet 1321 and a mounting portion 1322. The mounting portion 1322 protrudes toward the cover plate 120 (e.g., protruding upward). The mounting portion 1322 extends along a length direction of the mounting plate 132 and is located in the middle of the mounting plate 132 along a width direction (e.g., the front-rear direction). The bayonet 1321 is disposed on the mounting portion 1322.

In some embodiments, as shown in FIGS. 3 and 5, the volute 420 includes an upper volute 421 and a lower volute 422. The fan assembly 400 further includes a third buckle 401 matched with the bayonet 1321. The third buckle 401 is disposed at a position (e.g., the bottom) of the lower volute 422 proximate to the bottom plate 114. A number of the third buckles 401 is same as that of the bayonets 1321, and the third buckles 401 are in one-to-one correspondence with the bayonets 1321. Each third buckle 401 is clamped to a corresponding bayonet 1321, thereby achieving a fixed connected between the volute 420 and the mounting plate 132, and further achieving the fixed connection between the volute 420 and the bottom plate 114.

In some embodiments, the bayonet 1321 may be directly disposed on the bottom plate 114. In this case, the third buckle 401 is clamped to the bayonet 1321, so that the volute 420 may be directly clamped to the bottom plate 114.

In some embodiments, as shown in FIGS. 4 and 11, the first heat-retaining member 210 further includes a third protruding portion 214. The third protruding portion 214 is disposed on a side of the first side wall 211 away from the third side plate 113 and corresponds to the position of the volute 420.

For example, referring to FIG. 4, in a case where the volute 420 is clamped to the bottom plate 114, the volute 420 further abuts against the third protruding portion 214, so that the third protruding portion 214 is elastically deformed. An elastic force generated by the third protruding portion 214 causes the connection between the third buckle 401 and the bayonet 1321 more secure, thereby improving a reliability of the connection between the volute 420 and the bottom plate 114.

It can be understood that, since the first heat-retaining member 210 is an integrally formed foam member having good shock absorption properties. Therefore, in a case where the volute 420 abuts against the third protruding portion 214, the vibration noise generated during an operation of the fan 430 may be reduced.

In some embodiments, as shown in FIG. 11, a position of the third protruding portion 214 corresponds to that of the second reinforcing rib 226. For example, in a case where the first side wall 211 abuts against the drain pan side plate 221, the third protruding portion 214 abuts against the second reinforcing rib 226, so as to improve a connection stability between the first heat-retaining member 210 and the drain pan 220A.

The ducted air conditioner 10A according to some embodiments of the present disclosure, the fan assembly 400 may be quickly positioned and fixed in the box body 110 through the cooperation of the bayonet 1321 and the third buckle 401. The mounting plate 132 and the bottom plate 114 are fixedly connected by a small number of rivets or screws, which simplifies the installation process and improves the mounting efficiency. In addition, a tension between the third buckle 401 and the bayonet 1321 and a transverse shear force of the rivet or screw may enhance a connection strength between the box body 110 and the fan assembly 400 and improve a reliability of the connection.

In some embodiments, as shown in FIGS. 2, 3 and 5, the housing 100 further includes a hook assembly 118. For example, the hook assembly 118 is disposed on a side of the second side plate 112 away from the first side plate 111. The hook assembly 118 includes a third fixing plate 1181, a hook 1182 and a hanger. The hook 1182 is connected to the third fixing plate 1181 and is perpendicular to the third fixing plate 1181 and extends away from the second side plate 112. The hanger is disposed on a side of the third fixing plate 1181 proximate to the second side plate 112. The second side plate 112 includes a hanging opening 1125 matching with the hanger. The hook assembly 118 may be fixedly connected to the housing 100 by connecting the hanger to the hanging opening 1125.

Of course, in some embodiments, the electrical control box right side plate 514 may further be provided with the hanging opening 1125 matching the hanger, which is not limited thereto.

Figure 14:
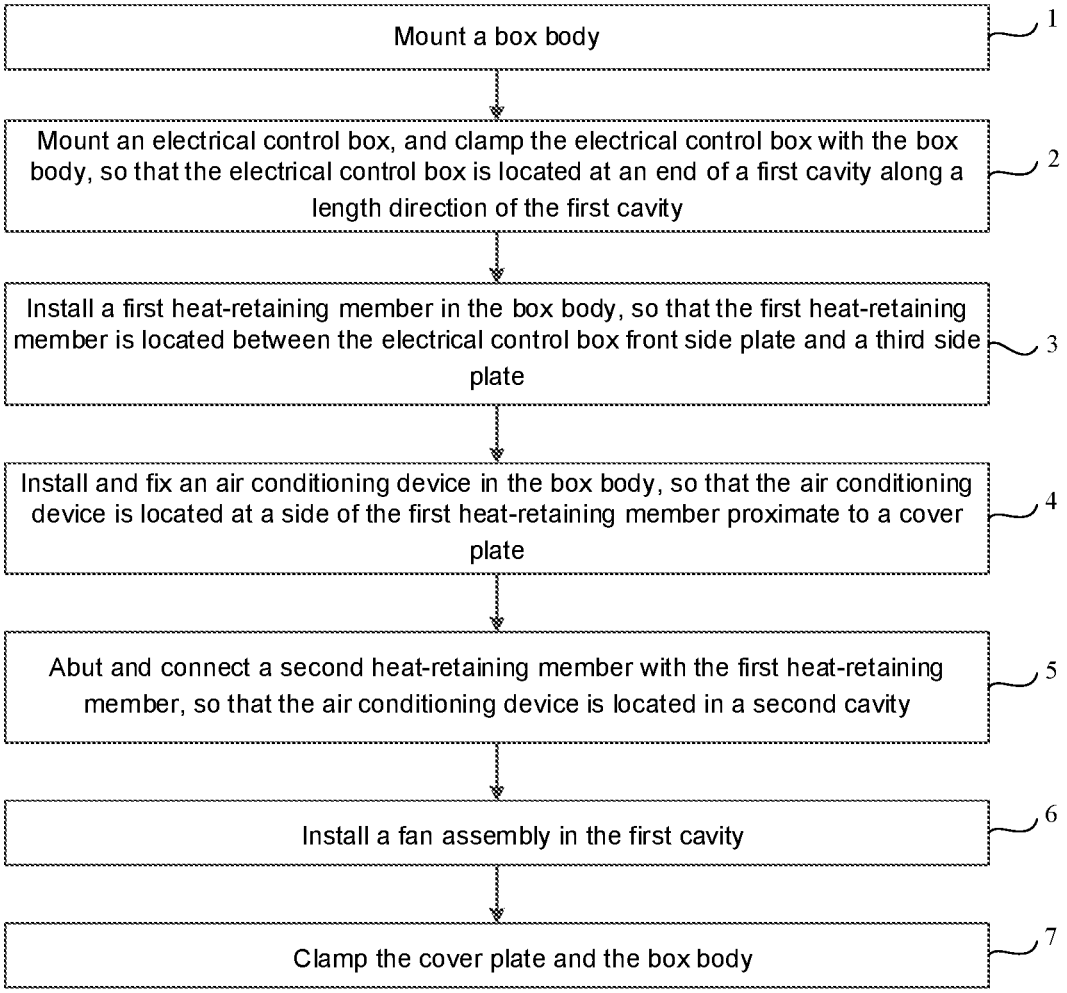
FIG. 14 is a flow diagram of an assembling method of a ducted air conditioner, in accordance with some embodiments.

Some embodiments of the present disclosure further provide an assembling method of the ducted air conditioner. As shown in FIG. 14, the method includes steps 1 to 7.

Step 1 includes an operation to mount the box body 110. The opening 105 of the mounted box body 110 is placed upward.

Figure 15:
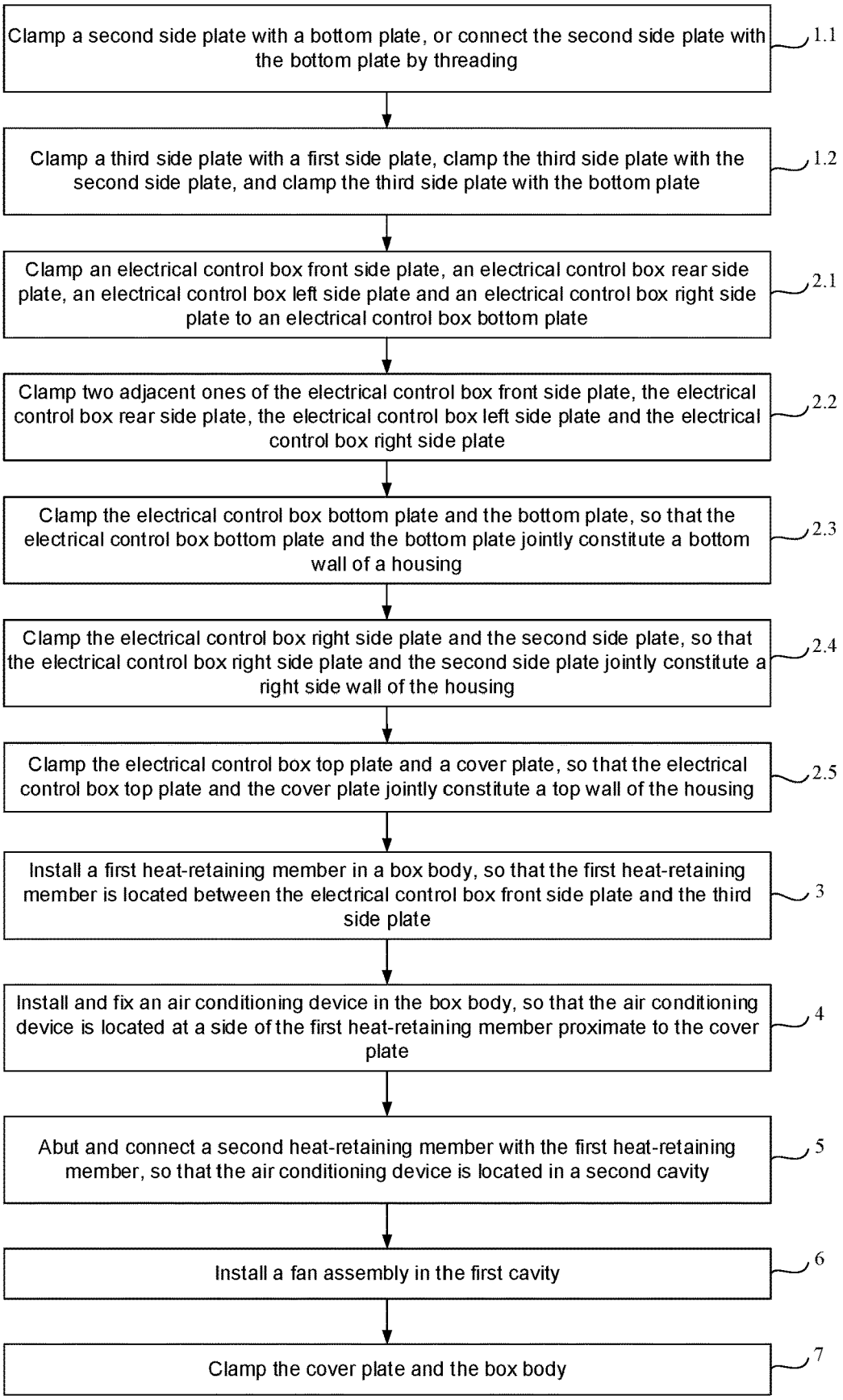
FIG. 15 is a flow diagram of another assembling method of a ducted air conditioner, in accordance with some embodiments.

In some embodiments, as shown in FIG. 3, the box body 110 includes the first side plate 111, the second side plate 112, the third side plate 113 and the bottom plate 114. The first side plate 111 and the bottom plate 114 are of the bent integral member. As shown in FIG. 15, an assembling method of the box body 110 includes steps 1.1 to 1.2.

Step 1.1 includes an operation to clamp the second side plate 112 with the bottom plate 114, or connect the second side plate 112 to the bottom plate 114 by threading.

Step 1.2 includes an operation to clamp the third side plate 113 with the first side plate 111, clamp the third side plate 113 with the second side plate 112, and clamp the third side plate 113 with the bottom plate 114.

Step 2 includes an operation to mount the electrical control box 510, and clamp the electrical control box 510 with the second side plate 112 and the bottom plate 114 respectively, so that the electrical control box 510 is located at an end (e.g., the right end) of the first cavity 101 along the length direction.

In some embodiments, as shown in FIG. 3, the electrical control box 510 further includes the electrical control box front side plate 511, the electrical control box rear side plate 512, the electrical control box left side plate 513, the electrical control box right side plate 514, the electrical control box top plate 515 and the electrical control box bottom plate 516. As shown in FIG. 15, an assembling method of the electrical control box 510 includes steps 2.1 to 2.5.

Step 2.1 includes an operation to clamp the electrical control box front side plate 511, the electrical control box rear side plate 512, the electrical control box left side plate 513 and the electrical control box right side plate 514 to the electrical control box bottom plate 516.

Step 2.2 includes an operation to clamp two adjacent ones of the electrical control box front side plate 511, the electrical control box rear side plate 512, the electrical control box left side plate 513 and the electrical control box right side plate 514.

For example, the electrical control box front side plate 511 and the electrical control box left side plate 513, the electrical control box left side plate 513 and the electrical control box rear side plate 512, the electrical control box rear side plate 512 and the electrical control box right side plate 514, and the electrical control box right side plate 514 and the electrical control box front side plate 511 are all fixedly connected in the clamping manner.

Step 2.3 includes an operation to clamp the electrical control box bottom plate 516 and the bottom plate 114, so that the electrical control box bottom plate 516 and the bottom plate 114 jointly constitute the bottom wall of the housing 100.

Step 2.4 includes an operation to clamp the electrical control box right side plate 514 and the second side plate 112, so that the electrical control box right side plate 514 and the second side plate 112 jointly constitute the right side wall of the housing 100.

Step 2.5 includes an operation to clamp the electrical control box top plate 515 and the cover plate 120, so that the electrical control box top plate 515 and the cover plate 120 jointly constitute the top wall of the housing 100.

It will be noted that, as shown in FIG. 3, in a case where the electrical control box 510 is installed in the box body 110, the distance D1 (referring to FIG. 5) between the electrical control box front side plate 511 and the third side plate 113 is substantially equal to the dimension of the first heat-retaining member 210 in the width direction of the box body 110.

Step 3 includes an operation to install the first heat-retaining member 210 in the box body 110, so that the first heat-retaining member 210 is located between the electrical control box front side plate 511 and the third side plate 113.

For example, the front side surface of the first heat-retaining member 210 abuts against the third side plate 113 of the box body 110.

It can be understood that, the first heat-retaining member 210 may be positioned through the cooperation between the electrical control box front side plate 511 and the third side plate 113, so that the first heat-retaining member 210 may be installed in the box body 110 quickly and conveniently, thereby improving the mounting efficiency of the ducted air conditioner 10A.

Step 4 includes an operation to fix and install the air conditioning device 300 in the box body 110, so that the air conditioning device 300 is supported on the first heat-retaining member 210. In this case, the air conditioning device 300 is located at a side of the first heat-retaining member 210 proximate to the cover plate 120.

It will be noted that, the connecting manner between the air conditioning device 300 and the box body 110 may be referred to the corresponding descriptions in the above embodiments, which will not be repeated herein.

Step 5 includes an operation to abut the drain pan 220A with the first heat-retaining member 210, so that the air conditioning assembly 301 is located between the drain pan 220A and the first heat-retaining member 210.

For example, as shown in FIGS. 3 and 4, the first heat-retaining member 210 includes the first side wall 211 and the heat-retaining member bottom wall 212. The drain pan 220A includes the drain pan side plate 221 and the drain pan bottom plate 222. The ends of the first side wall 211 and the drain pan side plate 221 proximate to each other are connected in the abutting manner. The inner space of the housing 100 may be divided into the above first cavity 101 and second cavity 102 by abutting of the first side wall 211 and the drain pan side plate 221.

For example, the outer side of the upper end of the first side wall 211 (the rear side as shown in FIG. 4) is provided with the step 213, and the lower end of the drain pan side plate 221 abuts against the step 213.

Step 6 includes an operation to install the fan assembly 400 in the first cavity 101.

In some embodiments, referring to FIGS. 2, 3 and 5, the housing 100 further includes the fan mounting assembly 130. The fan mounting assembly 130 includes the motor mounting frame 131 and the mounting plate 132.

The fan assembly 400 includes the motor 410, the volute 420 and the fan 430. The fan 430 is provided in the volute 420. The motor 410 is fixedly mounted on the motor mounting frame 131. The volute 420 is fixedly connected to the box body 110 in the clamping manner.

It will be noted that, the fan assembly 400 is not connected to the above components other than the box body 110. Therefore, step 6 may be performed after step 5, or may be performed after any one of steps 1 to 4, the present disclosure is not limited thereto.

Step 7 includes an operation to install the cover plate 120 on the box body 110.

In some embodiments, the cover plate 120 is clamped with the box body 110 and closes the opening 105 of the box body 110. In addition, the cover plate 120 may further be fixedly connected with the motor mounting frame 131 by threading, so as to improve the mounting stability of the ducted air conditioner 10A.

A person skilled in the art will understand that, the scope of disclosure involved in the present disclosure is not limited to technical solutions formed by specific combinations of the above technical features, and shall cover other technical solutions formed by any combination of the above technical features or their equivalent features without departing from the concept of disclosure. For example, technical solutions formed by replacing the above features with technical features with similar functions disclosed in some embodiments (but not limited thereto).

What is claimed is:

1. A ducted air conditioner, comprising:

a housing having a cuboid structure and including:

a box body having an opening and including:

a first side plate constituting a left side wall of the housing;

a second side plate being parallel to the first side plate and constituting a portion of a right side wall of the housing;

a third side plate being perpendicular to the first side plate and the second side plate and constituting a front side wall of the housing; and a bottom plate constituting a portion of a bottom wall of the housing; and a cover plate configured to close the opening;

a heat-retaining and drainage assembly disposed in the housing and including:

a first heat-retaining member including a first dividing plate; and a second heat-retaining member stacking with the first heat-retaining member, the second heat-retaining member including a second dividing plate connected to the first dividing plate, wherein an inner space of the housing is divided to a first cavity and a second cavity, an arrangement direction of the first cavity and the second cavity is perpendicular to a stacking direction of the first heat-retaining member and the second heat-retaining member;

a fan assembly disposed in the first cavity;

an air conditioning device disposed in the second cavity, and located between the first heat-retaining member and the second heat-retaining member; and an electrical control box including:

an electrical control box top plate connected to the cover plate, and jointly constituting a top wall of the housing with the cover plate;

an electrical control box bottom plate connected to the bottom plate, and jointly constituting the bottom wall of the housing with the bottom plate; and an electrical control box right side plate connected to the second side plate, and jointly constituting the right side wall of the housing with the second side plate.

2. The ducted air conditioner according to claim 1, wherein, the electrical control box top plate is clamped with the cover plate, the electrical control box bottom plate is clamped with the bottom plate, and the electrical control box right side plate is clamped with the second side plate;

the electrical control box further includes an electrical control box front side plate, and the electrical control box front side plate is parallel to the third side plate; wherein, a distance between the electrical control box front side plate and the third side plate is substantially equal to a dimension of the heat-retaining and drainage assembly in a width direction of the box body, and the heat-retaining and drainage assembly is disposed between the electrical control box front side plate and the third side plate.

3. The ducted air conditioner according to claim 1, wherein the second heat-retaining member is configured as a drain pan, the drain pan is configured to receive condensed water discharged by the ducted air conditioner.

4. The ducted air conditioner according to claim 3, wherein, the first heat-retaining member includes:

a heat-retaining member bottom wall; and a first side wall, wherein the first side wall is perpendicular to the heat-retaining member bottom wall, and is connected to an end of the heat-retaining member bottom wall, the first side wall defines the first dividing plate;

the drain pan includes:

a drain pan bottom plate; and a drain pan side plate, wherein the drain pan side plate is perpendicular to the drain pan bottom plate, and is connected to an end of the drain pan bottom plate, the drain pan side plate defines the second dividing plate;

wherein, ends of the first side wall and the drain pan side plate proximate to each other are abutted, so as to divide the inner space of the housing into the first cavity and the second cavity.

5. The ducted air conditioner according to claim 4, wherein, the first heat-retaining member includes a first opening located at an edge of the first side wall proximate to the drain pan side plate, the first opening running through the first side wall;

the drain pan includes a second opening corresponding to the first opening, the second opening being located at an edge of the drain pan side plate proximate to the first side wall, and running through the drain pan side plate;

wherein, the first opening cooperates with the second opening to provide a vent, and the second cavity communicates with the first cavity through the vent.

6. The ducted air conditioner according to claim 4, wherein, the drain pan further includes a heat insulating layer disposed on a side of the drain pan bottom plate away from the heat-retaining member bottom wall, and bonded to the drain pan bottom plate;

the heat insulating layer is an integral member, and is configured to insulate heat transfer between the drain pan bottom plate and the housing.

7. The ducted air conditioner according to claim 4, wherein, the first heat-retaining member further includes a recess disposed at a position where the first side wall and the heat-retaining member bottom wall are connected along a length direction of the first heat-retaining member;

the box body further includes a motor mounting frame, the motor mounting frame including a protruding portion matched with the recess, and the protruding portion being disposed in the recess.

8. The ducted air conditioner according to claim 1, wherein, the box body further includes a box fixing member, the box fixing member being disposed on a surface of the first side plate proximate to the second side plate, and being located in the second cavity, the box fixing member being fixedly connected to the first side plate;

the air conditioning device includes:

an air conditioning assembly; and a first fixing member connected to the air conditioning assembly, located at an end of the air conditioning assembly proximate to the first side plate, and configured to cooperate with the box fixing member, so as to preliminarily fix the air conditioning assembly in the second cavity.

9. The ducted air conditioner according to claim 8, wherein, the air conditioning device further includes a first end plate located at an end of the air conditioning assembly proximate to the first side plate, and fixedly connected to the first fixing member;

the box fixing member includes:

a box fixing member body;

a slideway disposed on a surface of the box fixing member body proximate to the second side plate; and a first buckle disposed on an inner side wall of the slideway, and disposed away from the bottom plate;

the first fixing member includes:

a slide rail slidably connected to the slideway; and a first clamping groove clamped with the first buckle.

10. The ducted air conditioner according to claim 9, wherein, an end of the slideway away from the bottom plate is a free end, the free end is provided with a flared portion, and the flared portion is configured to increase in dimension in a direction from an end proximate to the bottom plate to an end away from the bottom plate.

11. The ducted air conditioner according to claim 8, wherein, the air conditioning device further includes:

a second fixing member connected to the air conditioning assembly and located at an end of the air conditioning assembly proximate to the second side plate;

the second fixing member is fixedly connected to the third side plate, so as to fix the air conditioning assembly in the second cavity.

12. The ducted air conditioner according to claim 11, wherein, the air conditioning device further includes a second end plate, and the second end plate including:

an end plate body located at an end of the air conditioning assembly away from the first side plate, and fixedly connected to the air conditioning assembly;

a first fixing plate connected to an end of the end plate body proximate to the third side plate and being perpendicular to the end plate body; and a second clamping groove disposed on the first fixing plate and running through the first fixing plate along a thickness direction of the first fixing plate;

the second fixing member includes:

a second fixing plate; and a second buckle disposed on the second fixing plate and clamped to the second clamping groove.

13. The ducted air conditioner according to claim 12, wherein, the second end plate further includes a third opening, the third opening running through the first fixing plate along a thickness direction of the first fixing plate, and a position of the third opening away from the end plate body being open;

the second fixing member further includes a fixing column, the fixing column and the second buckle being located at a same side of the second fixing plate, and the fixing column being matched with the third opening.

14. The ducted air conditioner according to claim 13, wherein, the second fixing member further includes a first screw hole;

the third side plate includes a second screw hole, and the second screw hole is located at a position of the third side plate corresponding to the first screw hole;

a screw is inserted through the first screw hole and the second screw hole to fix the second fixing member and the third side plate.

15. The ducted air conditioner according to claim 11, wherein the box fixing member, the first fixing member and the second fixing member are all rubber member or plastic member.

16. The ducted air conditioner according to claim 1, wherein the box body further includes a piping mounting hole, at least a portion of the piping mounting hole being disposed on the second side plate;

the air conditioning device includes an air conditioning assembly, and the air conditioning assembly having a piping disposed at an end of the air conditioning assembly proximate to the second side plate, and inserted through the piping mounting hole.

17. The ducted air conditioner according to claim 1, wherein, the box body further includes a motor mounting frame fixedly connected to the bottom plate;

the box body further includes:

a mounting plate, the mounting plate being closer to the bottom plate than the motor mounting frame, and the mounting plate being fixedly connected to the bottom plate and the motor mounting frame;

the fan assembly includes:

a motor fixedly installed on the motor mounting frame;

a fan, the motor being connected to the fan, so as to drive the fan to rotate; and a volute, the fan being disposed in the volute, and the volute being clamped with the mounting plate.

18. The ducted air conditioner according to claim 1, wherein, the first heat-retaining member includes:

a heat-retaining member bottom wall; and a first side wall, wherein the first side wall is perpendicular to the heat-retaining member bottom wall, and is connected to an end of the heat-retaining member bottom wall; and a recess disposed at a position where the first side wall and the heat-retaining member bottom wall are connected along a length direction of the first heat-retaining member;

the box body further includes a motor mounting frame, the motor mounting frame including a protruding portion matched with the recess, and the protruding portion being disposed in the recess.

19. An assembling method of a ducted air conditioner, the ducted air conditioner including a housing, an electrical control box, a heat-retaining and drainage assembly, an air conditioning device and a fan assembly;

the housing including:

a box body having an opening; and a cover plate configured to close the opening;

the heat-retaining and drainage assembly including a first heat-retaining member and a second heat-retaining member, wherein the first heat-retaining member includes a first dividing plate, the second heat-retaining member is stacked with the first heat-retaining member, the second heat-retaining member includes a second dividing plate connected to the first dividing plate, and an inner space of the housing is divided to a first cavity and a second cavity, an arrangement direction of the first cavity and the second cavity is perpendicular to a stacking direction of the first heat-retaining member and the second heat-retaining member;

the method comprising:

mounting the box body;

mounting the electrical control box, and clamping the electrical control box with the box body, so that the electrical control box is located at an end of the first cavity along a length direction of the first cavity;

installing the first heat-retaining member in the box body, so that the first heat-retaining member is located between the electrical control box and a third side plate of the box body;

installing and fixing the air conditioning device in the box body, so that the air conditioning device is located at a side of the first heat-retaining member proximate to the cover plate;

abutting and connecting the second heat-retaining member with the first heat-retaining member, so that the air conditioning device is located in the second cavity;

installing the fan assembly in the first cavity; and clamping the cover plate and the box body.

20. A ducted air conditioner, comprising:

a housing;

a heat-retaining and drainage assembly disposed in the housing and including:

a first heat-retaining member including a first dividing plate; and a second heat-retaining member stacking with the first heat-retaining member, the second heat-retaining member including a second dividing plate connected to the first dividing plate, wherein an inner space of the housing is divided to a first cavity and a second cavity, an arrangement direction of the first cavity and the second cavity is perpendicular to a stacking direction of the first heat-retaining member and the second heat-retaining member;

a fan assembly disposed in the first cavity; and an air conditioning device disposed in the second cavity, and located between the first heat-retaining member and the second heat-retaining member;

wherein the second heat-retaining member is configured as a drain pan, the drain pan is configured to receive condensed water discharged by the ducted air conditioner;

wherein the first heat-retaining member includes:

a heat-retaining member bottom wall; and a first side wall, wherein the first side wall is perpendicular to the heat-retaining member bottom wall, and is connected to an end of the heat-retaining member bottom wall, the first side wall defines the first dividing plate;

the drain pan includes:

a drain pan bottom plate; and a drain pan side plate, wherein the drain pan side plate is perpendicular to the drain pan bottom plate, and is connected to an end of the drain pan bottom plate, the drain pan side plate defines the second dividing plate;

wherein ends of the first side wall and the drain pan side plate proximate to each other are abutted, so as to divide the inner space of the housing into the first cavity and the second cavity.

* * * * *